US009348311B2

(12) United States Patent
Watanabe et al.

(10) Patent No.: US 9,348,311 B2
(45) Date of Patent: May 24, 2016

(54) RECORDING MEDIUM CONVEYOR AND IMAGE FORMING APPARATUS INCORPORATING SAME

(71) Applicants: Takeshi Watanabe, Kanagawa (JP); Kenji Ishii, Ibaraki (JP); Tomoyasu Hirasawa, Kanagawa (JP); Keisuke Ikeda, Kanagawa (JP)

(72) Inventors: Takeshi Watanabe, Kanagawa (JP); Kenji Ishii, Ibaraki (JP); Tomoyasu Hirasawa, Kanagawa (JP); Keisuke Ikeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/565,861

(22) Filed: Dec. 10, 2014

(65) Prior Publication Data

US 2015/0160610 A1 Jun. 11, 2015

(30) Foreign Application Priority Data

Dec. 11, 2013 (JP) ..... 2013-255811
May 16, 2014 (JP) ..... 2014-102160

(51) Int. Cl.

| | |
|---|---|
| ***B65H 5/02*** | (2006.01) |
| ***G03G 21/20*** | (2006.01) |
| ***G03G 15/00*** | (2006.01) |
| ***B65H 29/12*** | (2006.01) |

(52) U.S. Cl.

CPC ..... *G03G 21/206* (2013.01); *B65H 29/12* (2013.01); *G03G 15/6529* (2013.01); *G03G 15/6573* (2013.01); *B65H 5/023* (2013.01); *B65H 5/026* (2013.01); *B65H 2301/5144* (2013.01); *B65H 2404/262* (2013.01); *B65H 2404/268* (2013.01); *B65H 2404/2612* (2013.01); *B65H 2404/612* (2013.01); *B65H 2801/27* (2013.01); *G03G 2215/0129* (2013.01)

(58) Field of Classification Search

CPC ..... B65H 5/023; B65H 5/025; B65H 5/026; B65H 2301/5144; B65H 2404/2612

See application file for complete search history.

(56) References Cited

U.S. PATENT DOCUMENTS 4,261,112 A * 4/1981 Apitz ..... F26B 13/183 165/90
4,719,707 A * 1/1988 Klapp ..... 34/94

(Continued)

FOREIGN PATENT DOCUMENTS

| | | |
|---|---|---|
| JP | 2004-198863 | 7/2004 |
| JP | 2011-057389 | 3/2011 |
| JP | 2012-098677 | 5/2012 |

OTHER PUBLICATIONS

U.S. Appl. No. 14/487,435, filed Sep. 16, 2014.

(Continued)

*Primary Examiner* — Howard Sanders

(74) *Attorney, Agent, or Firm* — Oblon, McClelland, Maier & Neustadt, L.L.P.

(57) ABSTRACT

A recording medium conveyor, which is incorporated in an image forming apparatus, includes a first conveyor and a second conveyor disposed facing the first conveyor. The first conveyor and the second conveyor sandwich a recording medium therebetween and convey the recording medium to a downstream side of an image forming apparatus in a recording medium conveying direction. At least one of the first conveyor and the second conveyor includes a belt having an inner circumferential face, and a cooler to cool the recording medium. The cooler has a heat absorbing face that contacts the inner circumferential face of the belt and that has an air flow path formed thereon to expose the inner circumferential face of the belt to open air.

19 Claims, 14 Drawing Sheets

(56) References Cited

U.S. PATENT DOCUMENTS

| | | | | |
|---|---|---|---|---|
| 5,071,513 | A * | 12/1991 | Bluhm | D21F 3/0281 100/311 |
| 5,970,301 | A * | 10/1999 | De Cock | 430/124.3 |
| 2012/0315069 | A1 | 12/2012 | Ikeda et al. | |
| 2013/0259512 | A1 | 10/2013 | Ikeda et al. | |
| 2014/0060782 | A1 | 3/2014 | Ikeda et al. | |
| 2014/0186080 | A1 | 7/2014 | Ikeda et al. | |
| 2014/0186081 | A1 | 7/2014 | Hirasawa et al. | |
| 2014/0233996 | A1 | 8/2014 | Ikeda et al. | |
| 2014/0308058 | A1 | 10/2014 | Ikeda et al. | |

OTHER PUBLICATIONS

U.S. Appl. No. 14/477,129, filed Sep. 4, 2014.

* cited by examiner

RECORDING MEDIUM CONVEYOR AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2013-255811, filed on Dec. 11, 2013, and 2014-102160, filed on May 16, 2014, in the Japan Patent Office, the entire disclosure of each of which is hereby incorporated by reference herein.

BACKGROUND

1. Technical Field

This disclosure relates to a recording medium conveyor and an image forming apparatus including the sheet conveyor.

2. Related Art

Electrophotographic image forming apparatuses such as copiers, printers, facsimile machines, and multi-functional devices having at least two of the copiers, printers, and facsimile machines. Some of the above-described image forming apparatuses includes a sheet conveyor (a cooler type sheet conveyor) to convey a recording medium to which a toner image is fixed. The sheet conveyor includes a cooler, a first conveyor belt in contact with the cooler, and a second conveyor belt disposed facing the first conveyor belt. The recording medium having the fixed toner image thereon is sandwiched and conveyed by the first conveyor belt and the second conveyor belt. By so doing, heat of the recording medium is transmitted to the cooler via the first conveyor belt.

In order to prevent close contact of the first conveyor belt and the cooler, a technique in which a gap is formed between a cooling face (a heat absorbing face) of the cooler and the first conveyor belt is disclosed.

SUMMARY

At least one aspect of this disclosure provides a recording medium conveyor including a first conveyor and a second conveyor disposed facing the first conveyor. The first conveyor and the second conveyor sandwich a recording medium therebetween and convey the recording medium to a downstream side of an image forming apparatus in a recording medium conveying direction. At least one of the first conveyor and the second conveyor includes a belt having an inner circumferential face and a cooler to cool the recording medium. The cooler has a heat absorbing face that contacts the inner circumferential face of the belt and that has an air flow path formed thereon to expose the inner circumferential face of the belt to open air.

Further, at least one aspect of this disclosure provides an image forming apparatus including an image forming part to form an image on a recording medium and the above-described recording medium conveyor to convey the recording medium.

DETAILED DESCRIPTION

Figure 1:
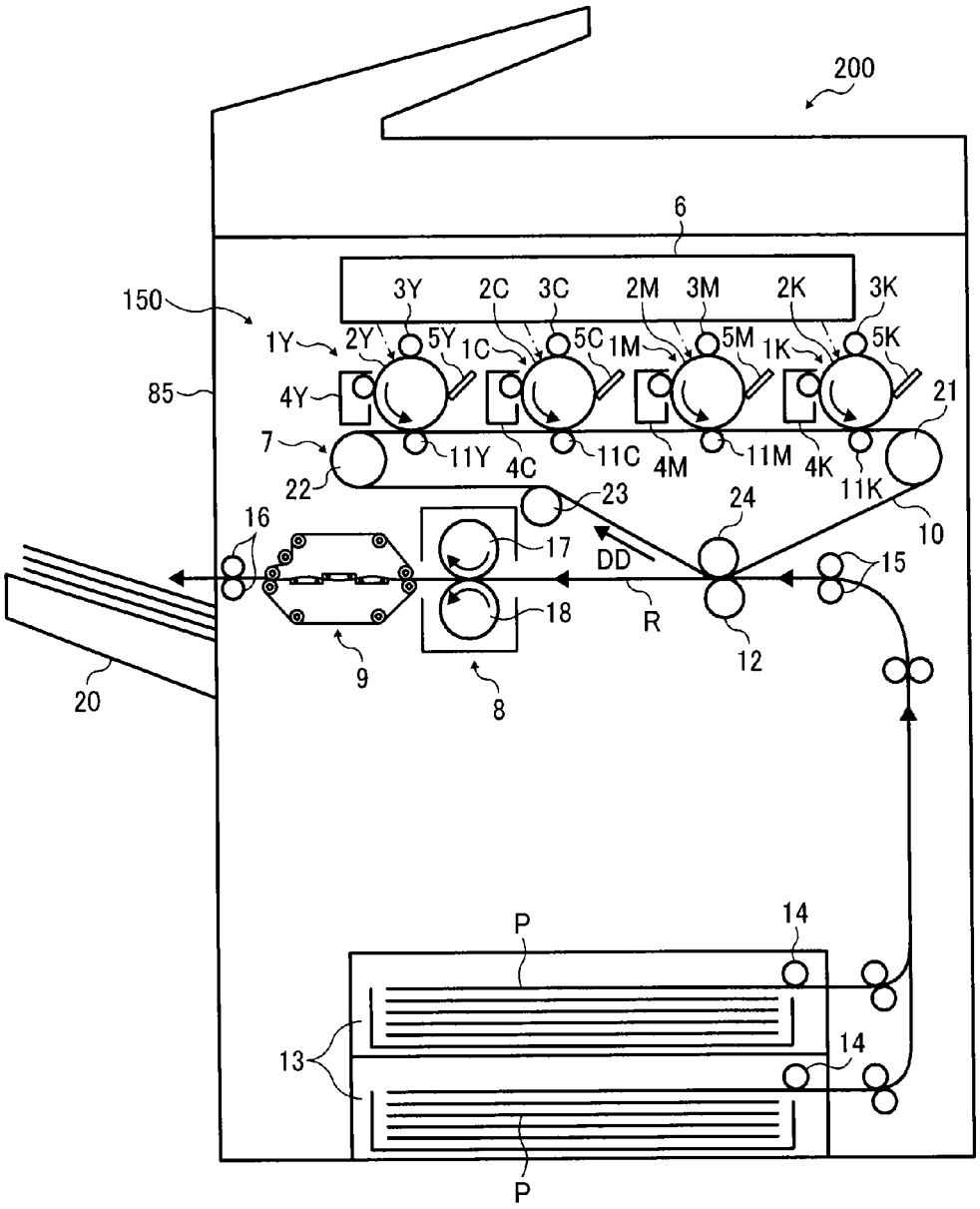
FIG. 1 is a schematic diagram illustrating a color image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an image forming apparatus 200 according to an example of this disclosure.

The image forming apparatus 200 may be a copier, a printer, a scanner, a facsimile machine, a plotter, and a multifunction peripheral or a multifunction printer (MFP) having at least one of copying, printing, scanning, facsimile, and plotter functions, or the like. According to the present example, the image forming apparatus 200 is an electrophotographic printer that forms toner images on a sheet or sheets by electrophotography.

Further, this disclosure is also applicable to image forming apparatuses adapted to form images through other schemes, such as known ink jet schemes, known toner projection schemes, or the like as well as to image forming apparatuses adapted to form images through electro-photographic schemes.

It is also to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, sheet member, and recording material to which the developer or ink is attracted.

A description is given of the color image forming apparatus 200 according to an example of this disclosure, with reference to FIG. 1.

FIG. 1 is a schematic diagram illustrating the color image forming apparatus 200 according to an example of this disclosure.

As illustrated in FIG. 1, the image forming apparatus 200 has an apparatus body 85 that includes a tandem-type image forming part 150, an exposure device 6, a transfer device 7, and four primary transfer rollers 11Y, 11C, 11M, and 11K.

The tandem-type image forming part 150 includes four process units 1Y, 1C, 1M, and 1K functioning as image forming units aligned in tandem. Suffixes, which are Y, C, M, and K, are used to indicate respective colors of toners (e.g., yellow, cyan, magenta, and black toners) for the process units. The process units 1Y, 1C, 1M, and 1K have substantially the same configuration except for containing different color toners of yellow (Y), cyan (C), magenta (M), and black (K) corresponding to color separation components of a color image. The process units 1Y, 1C, 1M, and 1K are detachably attachable to the apparatus body 85 of the image forming apparatus 200.

The four process units 1Y, 1C, 1M, and 1K form respective single color toner images of yellow (Y), cyan (C), magenta (M), and black (K) on photoconductors 2Y, 2C, 2M, and 2K, respectively. The exposure device 6 is disposed above the process units 1Y, 1C, 1M, and 1K and exposes respective surfaces of the photoconductors 2Y, 2C, 2M, and 2K, respectively, to form respective electrostatic latent images thereon.

It is to be noted that FIG. 1 illustrates the four process units 1Y, 1C, 1M, and 1K having the identical configuration and functions to each other except toner colors, which are yellow (Y), magenta (M), cyan (C), and black (K). Each process unit 1 includes the photoconductor 2 (i.e., photoconductors 2Y, 2C, 2M, and 2K) and an image forming components disposed around the photoconductor 2 in a counterclockwise direction in the drawing. Specifically, the image forming components are a charging roller 3 (i.e., charging rollers 3Y, 3C, 3M, and 3K) that is disposed substantially upward from a rotation center of the photoconductor 2, a developing device 4 (i.e., developing devices 4Y, 4C, 4M, and 4K), and a photoconductor cleaning blade 5 (i.e., photoconductor cleaning blades 5Y, 5C, 5M, and 5K).

Specifically, the photoconductor 2 has a drum shape and functions as a latent image bearer. The charging roller 3 serves as a charger to charge a surface of the photoconductor 2. The developing device 4 forms a toner image on the surface of the photoconductor 2. The photoconductor cleaning blade 5 serves as a cleaner to clean the surface of the photoconductor 2.

In FIG. 1, the exposure device 6 is disposed above the respective surfaces of the process units 1Y, 1C, 1M, and 1K. The exposing device 6 includes, e.g., a light source, polygon mirrors, f-θ lenses, and reflection lenses to irradiate a laser beam onto the surface of the photoconductor 2.

The transfer device 7 is disposed below the process units 1Y, 1C, 1M, and 1K. The transfer device 7 includes an intermediate transfer belt 10 including an endless belt that functions as a transfer body. The intermediate transfer belt 10 is stretched over multiple of rollers 21 through 24 functioning as supports. One of the rollers 21 through 24 is rotated as a driving roller to circulate (rotate) the intermediate transfer belt 10 in a direction indicated by arrow DD in FIG. 1.

Four primary transfer rollers 11Y, 11C, 11M, and 11K functioning as primary transfer units are disposed at positions at which the primary transfer rollers 11Y, 11C, 11M, and 11K face the respective photoconductors 2Y, 2C, 2M, and 2K. At the respective positions, the primary transfer rollers 11Y, 11C, 11M, and 11K are pressed against an inner circumferential surface of the intermediate transfer belt 10. Thus, primary transfer nip regions are formed at positions at which the photoconductors 2Y, 2C, 2M, and 2K contact pressed portions of the intermediate transfer belt 10. Each of the primary transfer rollers 11Y, 11C, 11M, and 11K is connected to a power source, and a given direct current (DC) voltage and/or an alternating current (AC) voltage are supplied to the primary transfer rollers 11.

A secondary transfer roller 12 that functions as a second transfer unit is disposed at a position at which the secondary transfer roller 12 faces the roller 24 that is one of the rollers over which the intermediate transfer belt 10 is stretched. The secondary transfer roller 12 is pressed against an outer circumferential surface of the intermediate transfer belt 10. Thus, a secondary transfer nip region is formed at a position at which the secondary transfer roller 12 and the intermediate transfer belt 10 contact each other. Similar to the primary transfer rollers 11Y, 11C, 11M, and 11K, the secondary transfer roller 12 is connected to a power source, and a given direct current (DC) voltage and/or an alternating current (AC) voltage are supplied to the secondary transfer roller 12.

Multiple sheet trays 13 are disposed below the apparatus body 85 to accommodate sheet-type recording medium P, such as sheets of paper or overhead projector (OHP) sheets. Each sheet tray 13 is provided with a feed roller 14 to feed the recording media P stored therein. An output tray 20 that functions as a sheet output unit is mounted on an outer circumferential surface of the apparatus body 85 at the left side in FIG. 1 to stack recording medium P discharged to an outside of the apparatus body 85.

The apparatus body 85 includes a recording medium conveying path R to transport a recording medium P from the sheet trays 13 to the output tray 20 through the secondary transfer nip region. On the recording medium conveying path R, registration rollers 15 are disposed upstream from the secondary transfer roller 12 in a transport direction of a recording medium (hereinafter, recording media transport direction). A fixing device 8, a recording medium cooling device 9, and output roller pair 16 are disposed in turn at positions downstream from the secondary transfer roller 12 in the recording media transport direction. The fixing device 8 includes a fixing roller 17 and a pressure roller 18. The fixing roller 17 functions as a fixing member including an internal heater. The pressure roller 18 that functions as a pressing member to press the fixing roller 17. A fixing nip region is formed at a position at which the fixing roller 17 and the pressing roller 18 contact each other.

Next, a description is given of a basic operation of the image forming apparatus 200 with reference to FIG. 1.

It is to be noted that the components and units having the identical configuration or structure except for toner color are occasionally described without suffixes. For example, the photoconductors 2Y, 2C, 2M, and 2K are hereinafter also referred to in a singular form as the photoconductor 2.

When imaging operation is started, the photoconductor 2 (i.e., the photoconductors 2Y, 2C, 2M, and 2K) of the process unit 1 (i.e., the process units 1Y, 1C, 1M, and 1K) is rotated counterclockwise in FIG. 1, and the charging roller 3 (i.e., the charging rollers 3Y, 3C, 3M, and 3K) uniformly charges the surface of the photoconductor 2 with a given polarity. Based on image information of a document read by a reading device, the exposing device 6 irradiates laser light onto the charged surface of the photoconductor 2 to form an electrostatic latent image on the surface of the photoconductor 2. At this time, image information exposed to each photoconductor 2 is single-color image information obtained by separating a desired full-color image into single-color information on yellow, cyan, magenta, and black. The developing device 4 (i.e., the developing devices 4Y, 4C, 4M, and 4K) supplies toner onto the electrostatic latent image formed on the photoconductor 2, thus making the electrostatic latent images a visible image as a toner image.

One of the rollers 21 to 24 over which the intermediate transfer belt 10 is stretched is driven for rotation to circulate the intermediate transfer belt 10 in the direction indicated by arrow DD in FIG. 1. A voltage having a polarity opposite a charged polarity of toner and subjected to constant voltage or current control is supplied to the primary transfer roller 11 (i.e., the primary transfer roller 11Y, 11C, 11M, and 11B). As a result, a transfer electric field is formed at the primary transfer nip region between each primary transfer roller 11 and the opposing photoconductor 2. Toner images of respective colors on the photoconductors 2 are transferred one on another onto the intermediate transfer belt 10 by the transfer electric fields formed at the primary transfer nip regions. Thus, the intermediate transfer belt 10 bears a full-color toner image on the surface of the intermediate transfer belt 10. Residual toner remaining on each photoconductor 2 without being transferred onto the intermediate transfer belt 10 is removed with the cleaning blade 5.

With rotation of the feed roller 14, a recording medium P is fed from the corresponding sheet tray 13. The recording medium P is further sent to the secondary transfer nip region between the secondary transfer roller 12 and the intermediate transfer belt 10 by the registration rollers 15 so as to synchronize with the full-color toner image on the intermediate transfer belt 10. At this time, a transfer voltage of the polarity opposite the charged polarity of toner of the toner image on the intermediate transfer belt 10 is supplied to the secondary transfer roller 12. As a result, a transfer electric field is formed at the secondary transfer nip region. By the transfer electric field formed at the secondary transfer nip region, the toner image on the intermediate transfer belt 10 is collectively transferred onto the recording medium P. Then, the recording medium P is sent into the fixing device 8, and the fixing roller 17 and the pressing roller 18 apply heat and pressure to fix the toner image on the recording medium P. After the recording medium P is cooled with the recording medium cooling device 9, the paired output rollers 16 output the recording medium P onto the output tray 20.

The above description relates to image forming operation for forming a full color image on a recording medium. In other image forming operation, a single color image can be formed by any one of the process units 1Y, 1C, 1M, and 1K, or a composite color image of two or three colors can be formed by two or three of the process units 1Y, 1C, 1M, and 1K.

Figure 2:
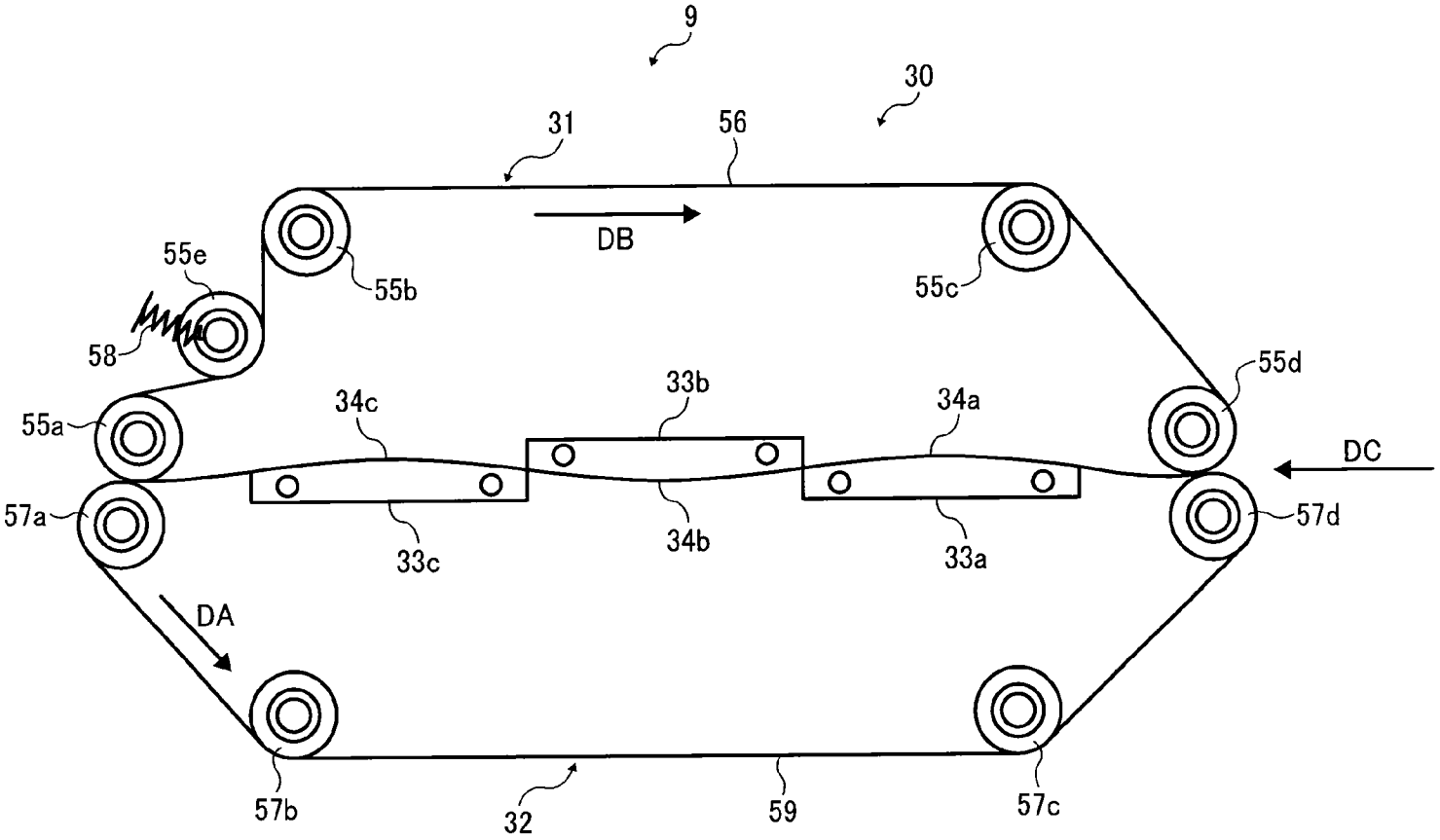
FIG. 2 is a schematic diagram illustrating a recording medium cooling device according to an example of this disclosure.

Now, FIG. 2 is a schematic diagram illustrating the recording medium cooling device 9 according to an example of this disclosure.

As illustrated in FIG. 2, the recording medium cooling device 9 that functions as a recording medium conveyor has cooling members 33*a*, 33*b*, and 33*c*, each functioning as a cooler to cool a sheet-type recording medium P conveyed by traveling of belts of a belt conveyance unit 30. The belt conveyance unit 30 includes a first conveyance assembly 31 and a second conveyance assembly 32. The first conveyance assembly 31 is disposed at one face side (front face side or upper face side) of the sheet-type recording medium P. The second conveyance assembly 32 is disposed at the other face side (back face side or lower face side) of the sheet-type recording medium P. Each of the first conveyance assembly 31 and the second conveyance assembly 32 has at least one of the cooling members 33*a*, 33*b*, and 33*c*. The cooling member (liquid cooling plate) 33*a* functions as a first cooling unit that is a pressing-member-side cooling unit disposed at the other face side (back face side or lower face side) of the sheet-type recording medium P. The cooling member 33*b* functions as a second cooling unit that is a fixing-member-side cooling unit disposed at the one face side (front face side or upper face side) of the sheet-type recording medium P. The cooling member 33*c* functions as a third cooling unit that is a pressing-member-side cooling unit disposed at the other face side (back face side or lower face side) of the sheet-type recording medium P.

The cooling members 33*a*, 33*b*, and 33*c* are disposed offset in a sheet conveying direction of the sheet-type recording medium P. The cooling member 33*b* at the one face side has, as a lower surface, a heat absorbing surface 34*b* of an arc surface shape slightly protruding downward. The cooling members 33*a* and 33*c* at the other face side have, as upper surfaces, heat absorbing surfaces 34*a* and 34*c* of an arc surface shape slightly protruding upward. Each of the cooling members 33*a*, 33*b*, and 33*c* includes a cooling-liquid channel through which cooling liquid flows.

Figure 3:
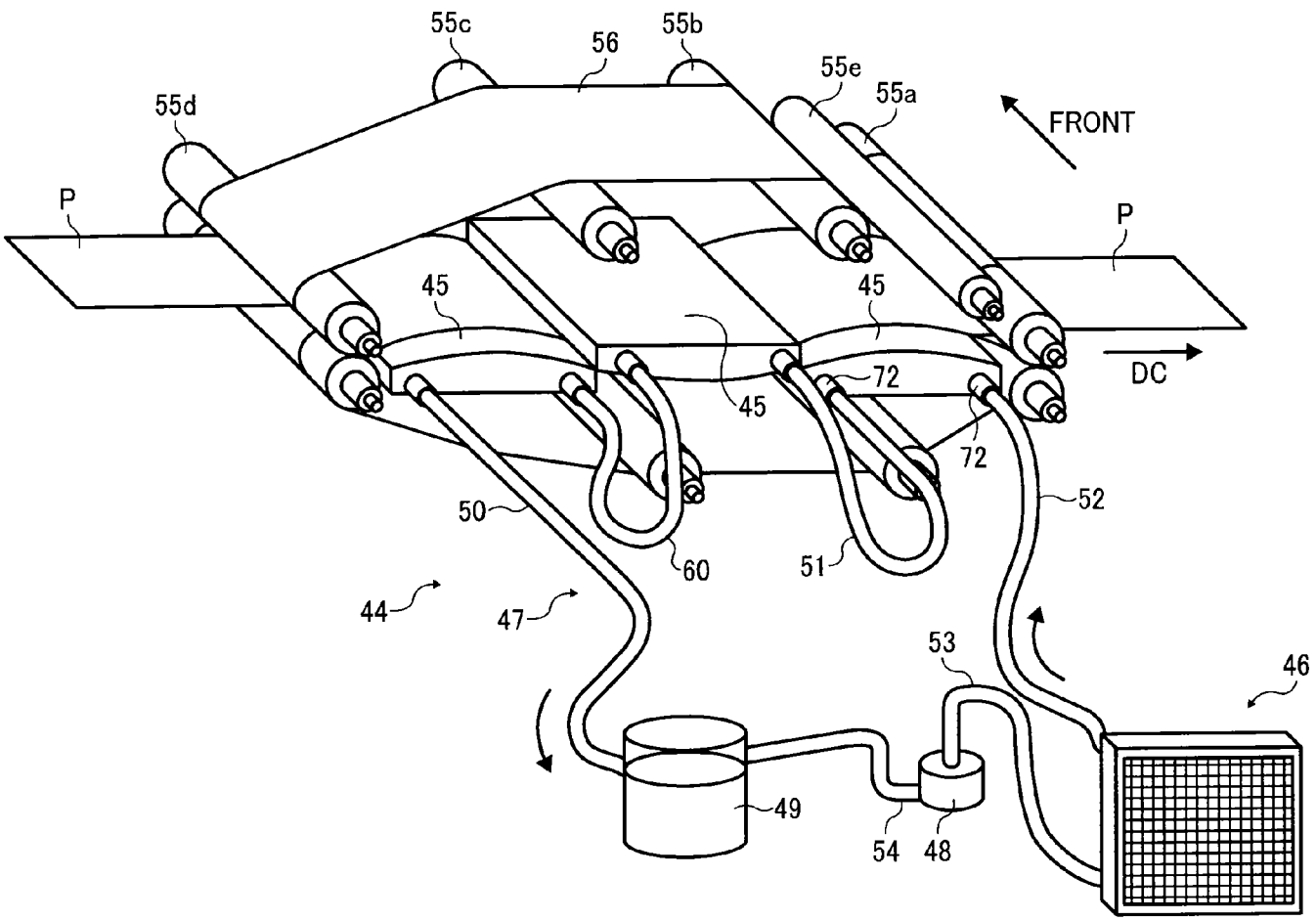
FIG. 3 is a schematic diagram illustrating a rear side of the recording medium cooling device of FIG. 2.

In other words, as illustrated in FIG. 3, the recording medium cooling device 9 has a cooling-liquid circuit 44. FIG. 3 is a schematic diagram illustrating a rear side of the recording medium cooling device 9 of FIG. 2. The cooling-liquid circuit 44 includes a heat receiving part 45 to receive heat from a recording medium P that functions as a heat generating part, a heat dissipating part 46 to radiate heat of the heat receiving part 45, and a circulation channel 47 to circulate cooling liquid through the heat receiving part 45 and the heat dissipating part 46. The circulation channel 47 includes a pump 48 to circulate cooling liquid and a liquid tank 49 to store cooling liquid. Each of the cooling members 33*a*, 33*b*, and 33*c*, which are, e.g., liquid cooling plates, functions as the heat receiving part 45. The heat dissipating part 46 includes, e.g., a radiator. The cooling liquid is, for example, a liquid that contains water as main component and an antifreeze (e.g., propylene glycol or ethylene glycol) to reduce the freezing point, and an antirust (e.g., phosphate medium Phosphoric acid potassium salt, or inorganic potassium salt) as additives.

The circulation channel 47 includes pipes 50, 60, 51, 52, 53, and 54. The pipe 50 connects a first opening of the cooling member 33*a* to the liquid tank 49. The pipe 60 connects a second opening of the cooling member 33*a* to a first opening of the cooling member 33*b*. The pipe 51 connects a second opening of the cooling member 33*b* to a first opening of the cooling member 33*c*. The pipe 52 connects a second opening of the cooling member 33*c* to the heat dissipating part 46 (e.g., radiator). The pipe 53 connects the heat dissipating part 46 to the pump 48. The pipe 54 connects the pump 48 to the liquid tank 49.

The circulation channel 47 including the pipes 50, 60, 51, 52, 53, and 54 forms a single channel. However, the circulation channel 47 meanders in the cooling members 33*a*, 33*b*, and 33*c*, thus allowing cooling liquid to effectively cool the cooling members 33*a*, 33*b*, and 33*c*.

The first conveyance assembly 31 includes multiple rollers (driven rollers) 55 (e.g., four rollers 55*a*, 55*b*, 55*c*, and 55*d* in FIG. 2), a belt (conveyance belt) 56, and a roller (driven roller) 55*e*. The belt 56 is wound around the multiple rollers 55. The roller 55*e* presses the belt 56 from outside to adjust a tension force of the belt 56. Each roller of the multiple rollers 55*a*, 55*b*, 55*c*, and 55*d*, and the roller 55*e* functions as a tensioner to tension the belt 56.

The second conveyance assembly 32 includes multiple rollers (driven rollers) 57*b*, 57*c*, and 57*d*, a driving roller 57*a* (four rollers in FIG. 2), and a belt (conveyance belt) 59 that is wound around the multiple rollers 57*b*, 57*c*, and 57*d* and the driving roller 57*a*.

Each roller of the multiple rollers 55*a*, 55*b*, 55*c*, and 55*d*, the roller 55*e*, and the multiple rollers 57*b*, 57*c*, and 57*d*, and the driving roller 57*a* is a tensioner to tension the belt 59.

Accordingly, a recording medium P is sandwiched and conveyed by the belt 56 of the first conveyance assembly 31 and the belt 59 of the second conveyance assembly 32 disposed facing the first conveyance assembly 31. In other words, as illustrated in FIG. 2, the belt 59 is traveled in a direction indicated by arrow DA (hereinafter, referred to as a direction DA) by driving of the driving roller 57*a*. Along with travel of the belt 59, the belt 56 of the first conveyance assembly 31 is traveled in a direction indicated by arrow DB (hereinafter, referred to as a direction DB) via the recording medium P sandwiched between the belts 56 and 59. Thus, the recording medium P is conveyed from an upstream side to a downstream side in a direction indicated by arrow DC in FIG. 2 (hereinafter, referred to as a direction DC).

Here, the driven roller 55*e* uses a spring 58 that functions as a biasing member to press the belt 56 from outside to adjust the tension force of the belt 56 appropriately. When the driven roller 55*e* stops applying pressing force and releases the belt 56 from the pressing force, the belt 56 slacks and can be taken out from the multiple rollers 55*a*, 55*b*, 55*c*, and 55*d*, and the roller 55*e* easily.

Next, a description is given of operation of the recording medium cooling device 9 having the above-described configuration.

When the recording medium P is sandwiched and conveyed by the belts 56 and 59, as illustrated in, e.g., FIG. 2, the first conveyance assembly 31 and the second conveyance assembly 32 are placed adjacent to each other. In a state illustrated in FIG. 2, if the driving roller 57*a* of the second conveyance assembly 32 is rotated, as described above, the belts 56 and 59 travel in the directions DA and DB, respectively, to convey the recording medium P in the direction DC. In such a state, cooling liquid is circulated in the cooling-liquid circuit 44. In other words, the pump 48 is activated to flow the cooling liquid through the cooling liquid channels of the cooling members 33*a*, 33*b*, and 33*c*.

At this time, an inner circumferential surface of the belt 56 of the first conveyance assembly 31 slides over the heat absorbing surface 34*b* of the cooling member 33*b*, and an inner circumferential surface of the belt 59 of the second conveyance assembly 32 slides over the heat absorbing surface 34*a* of the cooling member 33*a* and the heat absorbing surface 34*c* of the cooling member 33*c*. From a front face (upper face) side of the recording medium P, the cooling member 33*b* absorbs heat of the recording medium P via the belt 56. From a back face (lower face) side of the recording medium P, the cooling members 33*c* and 33*a* absorb heat of the recording medium P via the belt 59. In such a case, an amount of heat absorbed by the cooling members 33*a*, 33*b*, and 33*c* is transported to the outside by the cooling liquid, thus maintaining the cooling members 33*a*, 33*b*, and 33*c* at relatively low temperatures.

Specifically, by driving the pump 48, the cooling liquid is circulated through the cooling-liquid circuit 44. The cooling liquid flows through the cooling-liquid channels of the cooling members 33*a*, 33*b*, and 33*c*, absorbs heat of the cooling members 33*a* and 33*b*, and turns into a relatively high temperature. The cooling liquid at high temperature passes through the heat dissipating part 46 (e.g., radiator), and heat of the cooling liquid is radiated to outside air, thus reducing the temperature of the cooling liquid. The cooling liquid at relatively low temperature flows through the cooling-liquid channels again, and the cooling members 33*a*, 33*b*, and 33*c* act as the heat dissipating part 46. By repeating the above-described cycle, the recording medium P is cooled from both sides thereof.

In this example, the cooling members 33*a*, 33*b*, and 33*c* are arranged in the order of the lower face, the upper face, and the lower face from the upstream side to the downstream side in the sheet conveying direction of the recording medium P. The cooling members 33*a*, 33*b*, and 33*c* have substantially identical shapes to each other. The number of the contact cooling members of the second conveyance assembly 32 is greater than that of the first conveyance assembly 31. Specifically, two cooling members (i.e., the cooling members 33*a* and 33*c*) contact the second conveyance assembly 32 while one cooling member (i.e., the cooling member 33*b*) contacts the first conveyance assembly 31. With this configuration of the recording medium cooling device 9, a total contact area of the cooling members 33*a* and 33*c* to the inner circumferential surface of the belt 59 is greater than a total contact are of the cooling member 33*b* to the inner circumferential surface of the belt 56. Accordingly, a rotational resistance of the belt 56 of the first conveyance assembly 31 is smaller than a rotational resistance of the belt 59 of the second conveyance assembly 32. The driving roller 57*a* is disposed on the second conveyance assembly 32 that has a greater rotational resistance of the belt 59.

Here, respective protruding top faces of the heat absorbing surfaces 34*a* and 34*c* disposed on one side of the recording medium conveying path R and a protruding top face of the heat absorbing surface 34*b* disposed on the other side of the recording medium conveying path R are arranged to interdigitate each other in a direction intersecting the recording medium conveying direction. Accordingly, the belts 56 and 59 interdigitate and surely contact each other. As a result, rotations of the belts 56 and 59 are stabilized, so that a rotational speed difference generated between the belts 56 and 59 is reduced, and a highly reliable conveyance of a recording medium by the recording medium conveying belt can be achieved.

Figure 4:
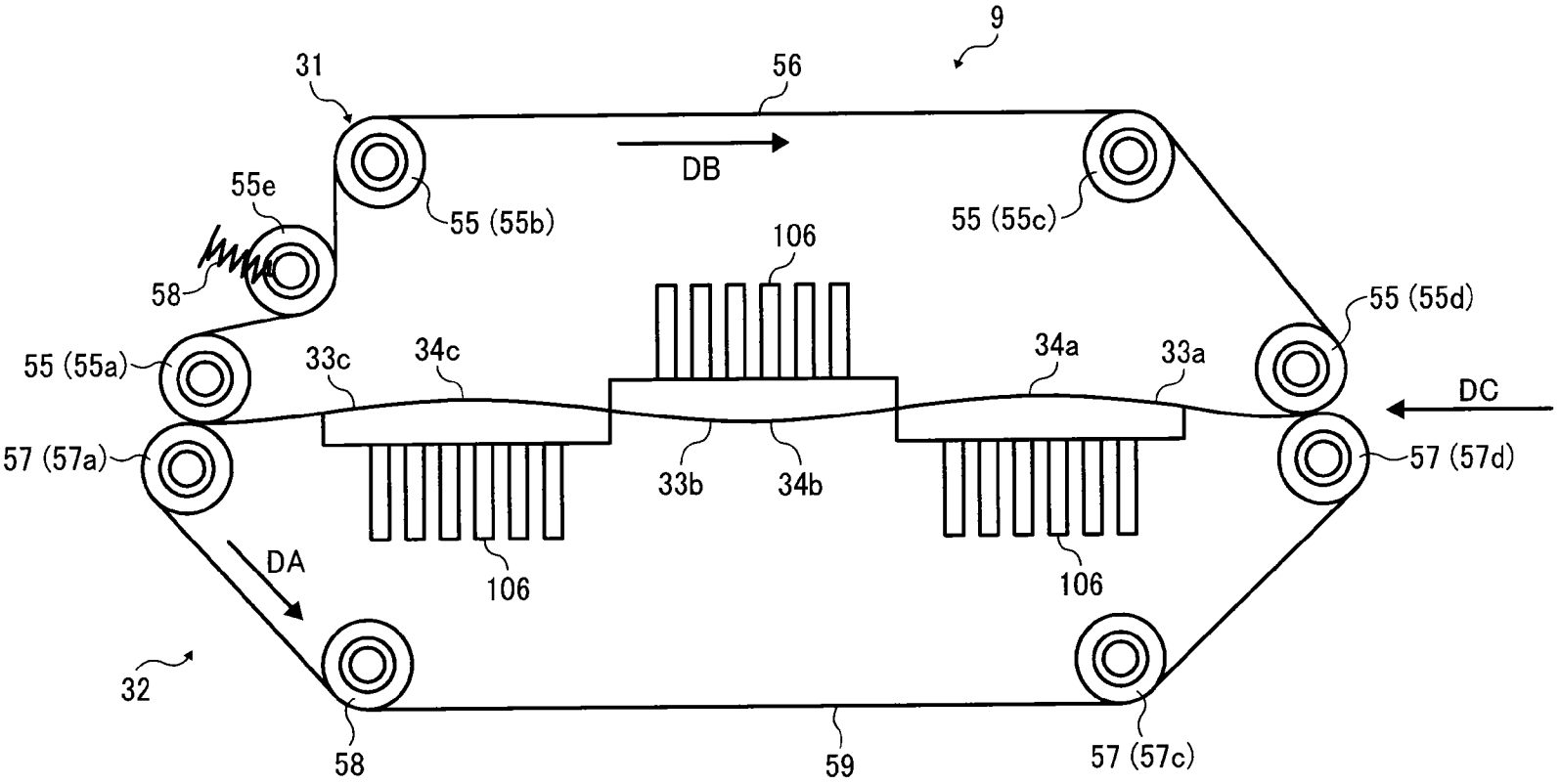
FIG. 4 is a schematic diagram illustrating a recording medium cooling device according to another example of this disclosure.

FIG. 4 is a schematic diagram illustrating the recording medium cooling device 9 according to another example of this disclosure.

In the example of this disclosure, the recording medium cooling device is not limited to the recording medium cooling device 9 employing the cooling-liquid circuit 44. For example, as illustrated in FIG. 4, the recording medium cooling device 9 may include a radiation facilitating part 106 having a shape of facilitating heat radiation. As the radiation facilitating part 106, for example, an air-cooling heat sink having multiple fins is employed. In such a configuration, the relative positions between the heat absorbing surfaces 34*a*, 34*b*, and 34*c* and the belts 56 and 59 described in any of the above-described examples are also applicable.

As described above, by using the air-cooling heat sink, the cooling-liquid circuit 44 can be omitted, and therefore a reduction in size and cost of the recording medium cooling device can be achieved.

Figure 5:
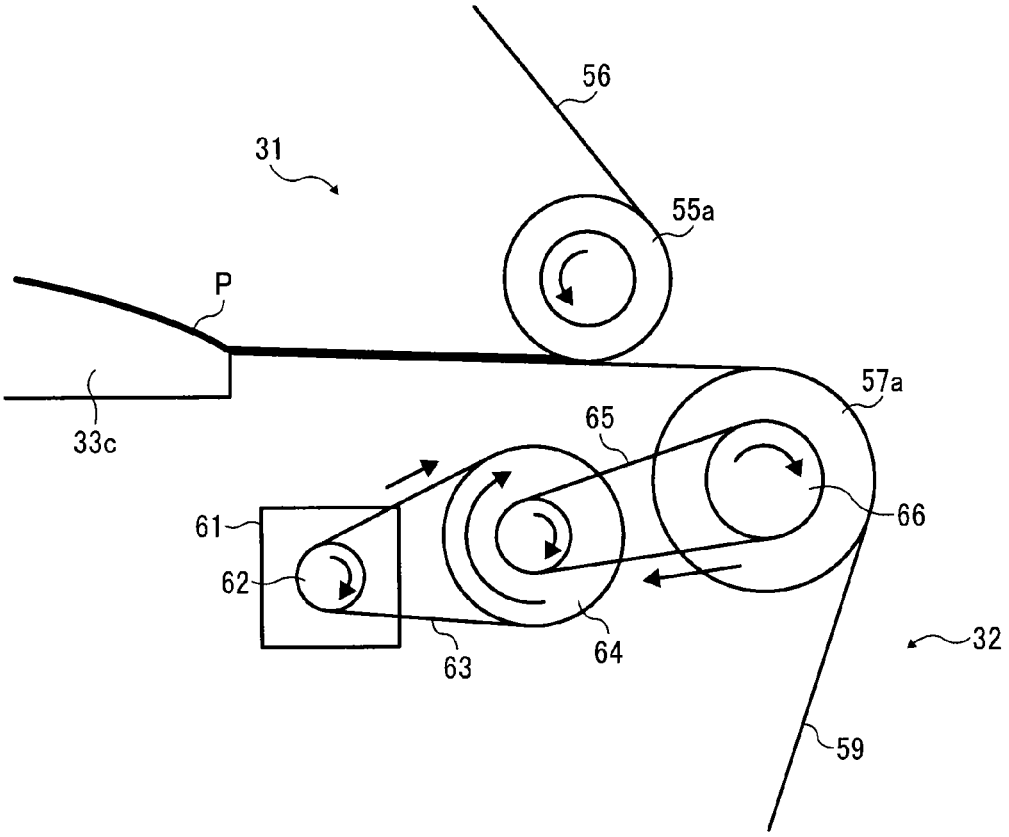
FIG. 5 is a partial rear view illustrating a first conveyance assembly and a second conveyance assembly.

Now, a description is given of the first conveyance assembly 31 and the second conveyance assembly 32 with reference to FIG. 5.

FIG. 5 is a partial rear view illustrating the first conveyance assembly 31 and the second conveyance assembly 32.

As illustrated in FIG. 5, the second conveyance assembly 32 further includes a driving motor 61 having a rotary shaft 62, a belt 63, a multi-stage pulley 64 having is a large-diameter pulley and a small-diameter pulley, a belt 65, and a shaft 66 that functions as a shaft of the driving roller 57*a*.

In the second conveyance assembly 32, the rotary shaft 62 of the driving motor 61 that functions as a driving unit rotates clockwise in FIG. 5. The belt 63 is wound around the rotary shaft 62 and the large-diameter pulley of the multi-stage pulley 64. The belt 65 is wound around the small-diameter pulley of the multi-stage pulley 64 and the shaft 66 of the driving roller 57*a*. According to this configuration, a driving force applied by the driving motor 61 is transmitted to the driving roller 57*a*.

As illustrated in FIG. 5, the driving roller 57*a* and the driven roller 55*a* are disposed not facing but adjacent to each other via the belts 56 and 59 at a recording medium exit of the recording medium cooling device 9. An upper end face of the driving roller 57*a* that is located at a lower position is arranged lower than a lower end face of the driven roller 55*a* that is located at an upper position. Similar to this configuration, the driven roller 55*d* and the driven roller 57*d* are disposed not facing but adjacent to each other via the belts 56 and 59 at a recording medium entrance of the recording medium cooling device 9. An upper end face of the driven roller 57*d* that is located at a lower position is arranged lower than a lower end face of the driven roller 55*d* that is located at an upper position. Therefore, the recording medium P conveyed from the fixing device 8 enters the recording medium cooling device 9 smoothly. As a result, when the recording medium P enters or exits from the recording medium cooling device 9, it is not likely a fixed image held on the recording medium P is distorted or has noise due to a heavy load applied to the recording medium P. Further, a portion where the belt 56 contacts an outer circumferential surface of the driven roller 55*a* and a portion where the belt 59 contacts an outer circumferential surface of the driving roller 57*a* do not contact and remain separated.

The belt 56 of the first conveyance assembly 31 and the belt 59 of the second conveyance assembly 32 contact in an area where the cooling members 33*a*, 33*b*, and 33*c* face the heat absorbing surfaces 34*a*, 34*b*, and 34*c*, respectively. The area where the heat absorbing surfaces 34*a*, 34*b*, and 34*c* are located between the belt 56 and belt 59 facing each other is a closed face (no openings are formed to suck the recording medium P). The driving roller 57*a* and the driven roller 55*a* are not in contact with each other. Further, the driven roller 57*d* and the driven roller 55*d* are not contact in each other. Therefore, as the driving roller 57*a* rotates in a direction indicated by arrow in FIG. 5, the belt 59 of the second conveyance assembly 32 also rotates. Accordingly, the belts 56 and 59 contact with each other throughout the area where the cooling members 33*a*, 33*b*, and 33*c* are located. As a result, a friction force generated between the belts 56 and 59 causes the belt 56 of the first conveyance assembly 31 to rotate.

This disclosure is not limited to the above-described configuration in which the belt 56 of the first conveyance assembly 31 is rotated with rotation of the belt 59. For example, this disclosure is applicable to a configuration in which the first conveyance assembly 31 further includes a driving roller, and a configuration in which a driving force is transmitted from the driving motor 61 to the driven roller 55*a* of the first conveyance assembly 31 via a linking member such as a gear and a belt.

Figure 6A:
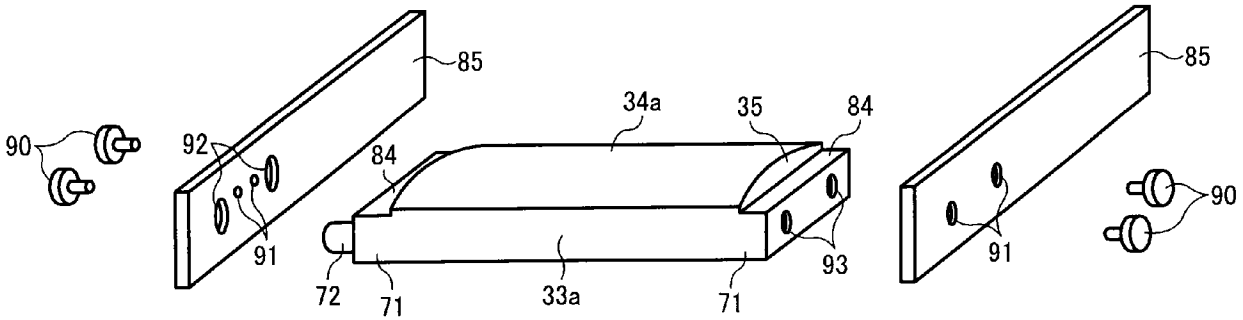
FIGS. 6A and 6B are schematic perspective views illustrating a relation between the recording medium cooling device, an apparatus body, and belts.
Figure 6B:
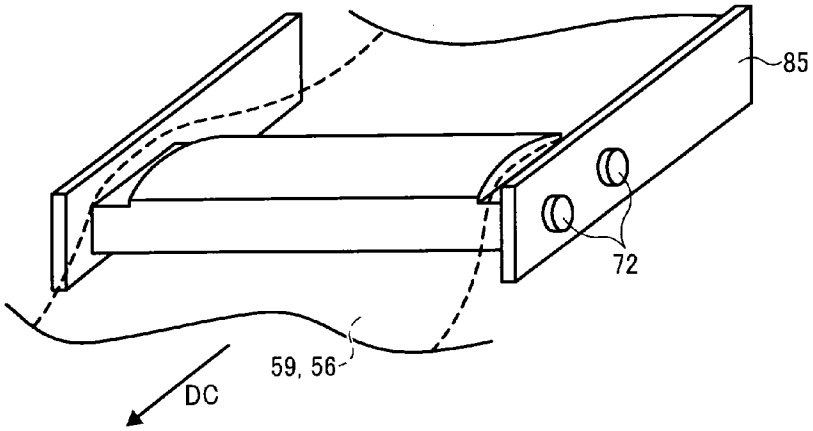

Next, a description is given of a relation between the cooling member 33, the apparatus body 85, and the belts 56 and 59 with reference to FIGS. 6A and 6B.

FIG. 6A is an exploded perspective view illustrating the relation of the cooling member 33*a*, the apparatus body 85, and the belts 56 and 59. FIG. 6B is an assembly chart illustrating the relation of the cooling member 33*a*, the apparatus body 85, and the belts 56 and 59. It is to be noted that, although FIGS. 6A and 6B illustrate the cooling member 33*a* alone, the drawings can also be applied to the cooling members 33*b* and 33*c*. Therefore, detailed description regarding the cooling members 33*b* and 33*c* are omitted.

As illustrated in FIG. 6A, the cooling member 33*a* includes protruding connectors 72 at one end of the belts 56 and 59 in a direction perpendicular to the belt moving direction (i.e., at one end of the belts 56 and 59 in a longitudinal direction of the cooling member 33*a*). The protruding connectors 72 are connected with pipes 51 and 52. Each of the protruding connectors 72 has a cylindrical shape and passes through engaging pores 92 formed on the apparatus body 85.

It is to be noted that, since the recording medium cooling device illustrated in FIG. 4 is not a liquid cooling device but is an air cooling device, pipes transporting heat correspond to the protruding connectors 72.

By contrast, at both longitudinal ends of the cooling member 33*a*, fastener holes 93 for fastening the cooling member 33*a* to the apparatus body 85 by fasteners 90 via attachment openings 91 formed on the apparatus body 85 through respective mounting holes 91 formed on the apparatus body 85.

Thus, the protruding connectors 72 of the cooling member 33*a* are engaged with respective engaging holes 92 of the apparatus body 85 and both end faces in the longitudinal direction of the cooling member 33*a* abut against the apparatus body 85. By so doing, the position of the cooling member 33*a* in the longitudinal direction is determined. Then, the fasteners 90 can fix the cooling member 33*a* to the apparatus body 85.

Further, the cooling member 33*a* has projecting portions 71 at both ends of the cooling member 33*a* in a direction perpendicular to the belt moving direction. The projecting portions 71 are located away from the heat absorbing surface 34*a* toward the direction perpendicular to the belt moving direction and have respective evacuation spaces 84 formed at a vertical position lower than the heat absorbing surface 34*a*.

As illustrated in FIG. 6B, the projecting portions 71 do not cause the belts 56 and 59 to close the side faces 35. Therefore, in a case of (multiple) recesses 100 illustrated in FIGS. 7 and 8 (see later), the inner circumferential surfaces of the belts 56 and 59 are exposed to air in the entire area in the belt conveying direction. It is to be noted that configurations illustrated in FIGS. 6A and 6B applicable to respective configurations of examples in reference with FIG. 9.

In FIG. 2, for example, as the belt 56 moves, air between the belt 56 and the heat absorbing surface 34*b* is evacuated to the outside therefrom. Consequently, the belt 56 and the heat absorbing surface 34*b* contact to each other, and therefore the contact area therebetween is closely adhered. Further, as the belt 56 moves, air between the belt 59 and the heat absorbing surface 34*a* and air between the belt 59 and the heat absorbing surface 34*c* are evacuated to the outside therefrom. Consequently, a contact area between the belt 59 and the heat absorbing surface 34*a* and a contact area between the belt 59 and the heat absorbing surface 34*c* are closely adhered. As a result, a frictional resistance between the belt 59 and the heat absorbing surface 34*a* and a frictional resistance between the belt 59 and the heat absorbing surface 34*c* increase to prevent the belt 59 from rotating smoothly.

It is known that a technique in which a gap is formed between a cooling face (a heat absorbing face or a heat absorbing surface) of the cooler and the first conveyor belt has been disclosed. However, the gap is at an end of the cooling face of the cooler and the first conveyor belt moves while contacting the substantially entire cooling face of the cooler. With this configuration, air between the first conveyor belt and the cooler is easily emptied, so that a contact area between the first conveyor belt and the cooler adheres to each other, which increases resistance between the cooling face of the cooler and the first conveyor belt.

In this disclosure, in order to prevent increase of the frictional resistance at the heat absorbing surfaces 34*a*, 34*b*, and 34*c* in contact with the belts 56 and 59, respective air flow paths are provided to the cooling members 33*a*, 33*b*, and 33*c* to expose the inner circumferential surfaces of the belts 56 and 59.

Next, a description is given of detailed configurations of the air flow paths in reference to FIGS. 7 through 14.

Figure 7A:
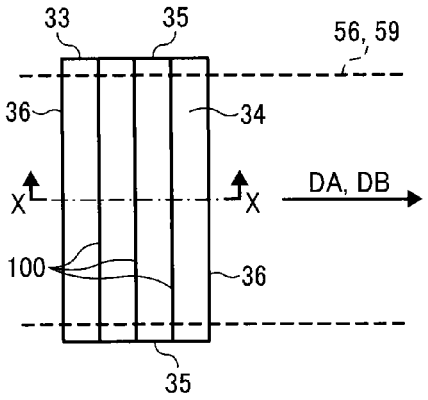
FIGS. 7A and 7B are diagrams illustrating air flow paths according to an example of this disclosure.
Figure 7B:
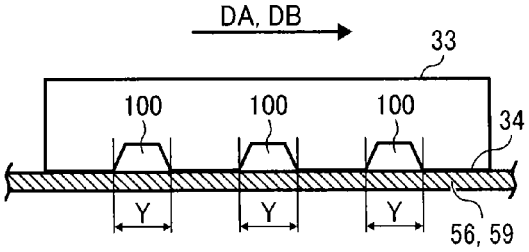

FIGS. 7A and 7B are diagrams illustrating the air flow paths (i.e., the recesses 100) according to an example of this disclosure. FIG. 7A is a plan view illustrating the air flow paths the heat absorbing surfaces 34, i.e., the heat absorbing surfaces 34*a*, 34*b*, and 34*c*. FIG. 7B is a cross sectional view illustrating the heat absorbing surfaces 34 along a line X-X of FIG. 7A.

The air flow paths are common to the heat absorbing surfaces 34*a*, 34*b*, and 34*c* of the cooling members 33*a*, 33*b*, and 33*c*, respectively. Therefore, hereinafter the following examples indicate one heat absorbing surface 34 and one belt (i.e., one of the belt 56 and the belt 59) which contacts the heat absorbing surface 34.

Since the cooling members 33*a*, 33*b*, and 33*c* have an identical structure to each other, hereinafter the cooling members 33*a*, 33*b*, and 33*c* are also referred simply to as the cooling member 33. Further, since the heat absorbing surfaces 34*a*, 34*b*, and 34*c* have an identical structure to each other, hereinafter the heat absorbing surfaces 34*a*, 34*b*, and 34*c* are also referred simply to as the heat absorbing surface 34.

As illustrated, the belt moving direction of the belts 56 and 59 extends in a left-to-right direction in FIGS. 7A and 7B. The multiple recesses (the recess shaped parts) 100 functioning as air flow paths to cause the inner circumferential surfaces of the belts 56 and 59 to contact outside air are formed on the heat absorbing surface 34 of the cooling member 33. The multiple recesses 100 on the heat absorbing surface 34 are arranged in a direction intersecting the belt moving direction. Specifically, the multiple recesses 100 on the heat absorbing surface 34 are arranged in a direction perpendicular to the belt moving direction.

By contrast, a width of the cooling member 33 is greater or wider than a belt width and each recess 100 is formed so as to penetrate through the full width of the cooling member 33 (i.e., the cooling liquid plate) across the side faces 35 of the cooling member 33. The side faces 35 are not closed by the belts 56 and 59. Therefore, air flowing through each recess 100 is not closed tightly between the belts 56 and 59 but flows through the recesses 100 across the entire widths of the belts 56 and 59 (in the direction perpendicular to the belt moving direction). Accordingly, the inner circumferential surfaces of the belts 56 and 59 contact outside air via the recesses 100, which prevents airtight between the belt 56 and the heat receiving surface 34 and between the belt 59 and the heat receiving surface 34.

Further, as can be seen from FIG. 7B, formation of the recessed 100 decreases the contact areas of the belts 56 and 59 and the heat receiving surface 34, and therefore the frictional resistances therebetween can be reduced.

According to this structure, the frequency and area of contact of the belts 56 and 59 and the heat absorbing surface 34 in a belt width direction (the direction perpendicular to the belt moving direction) can be equal, which can prevent occurrence of cooling nonuniformity. Specifically, when the belts 56 and 59 are seen in the belt moving direction along the line X-X of FIG. 7A, the frequency and area of contact of the belts 56 and 59 and the heat absorbing surface 34 can be equal at any position on the belts 56 and 59. Further, as can be seen from FIG. 7B, respective widths Y of the recesses 100 on the heat absorbing surface 34 in the belt moving direction are made substantially equal to each other, which can also prevent occurrence of cooling nonuniformity.

Since air flows through the recesses 100 naturally along with movement of the belts 56 and 59, no additional unit such as a fan is used to flow air through the recesses 100. Further, since the recesses 100 extend in the direction perpendicular to the belt moving direction, it is difficult to generate a force to disposition the belts 56 and 59 horizontally or in the left-to-right direction with respect to the belt moving direction. As a result, it becomes difficult to cause the belts 56 and 59 to move diagonally or to meander.

Figure 8A:
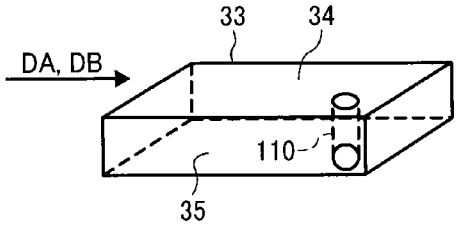
FIGS. 8A and 8B are diagrams illustrating an air flow path according to an example of this disclosure.
Figure 8B:
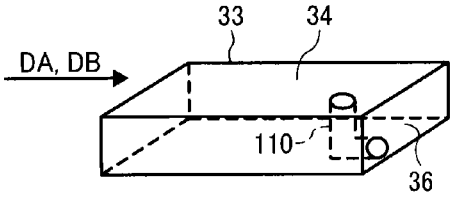

FIGS. 8A and 8B are diagrams illustrating another air flow path according to an example of this disclosure.

As illustrated in FIGS. 8A and 8B, a channel 110 that functions as an air flow path to cause the inner circumferential surfaces of the belts 56 and 59 to contact outside air are formed on the heat absorbing surface 34 of the cooling member 33.

As illustrated in FIG. 8A, one end opening of the channel 110 is formed on the heat absorbing surface 34 of the cooling member 33 and the other end opening of the channel 110 is formed not on the heat absorbing surface 34 of the cooling member 33 but on one of the side faces 35 of the same cooling member 33, so that the channel 110 penetrates through the cooling member 33 from the one end opening on the heat absorbing surface 34 to the other end opening of the side face 35.

By contrast, as illustrated in FIG. 8B, one end opening of the channel 110 is formed on the heat absorbing surface 34 of the cooling member 33 and the other end opening of the channel 110 is formed not on the heat absorbing surface 34 of the cooling member 33 but on one of side faces 36 (on a right side in the drawing) of the same cooling member 33, so that the channel 110 penetrates through the cooling member 33 from the one end opening on the heat absorbing surface 34 to the other end opening of the side face 36.

The side faces 35 and 36 are not closed by the belts 56 and 59.

Accordingly, the channel 110 penetrates the inside of the cooling member 33 so as to expose the heat absorbing surface 34 to outside air.

According to this structure, as the belts 56 and 59 move, air flows through the channel 110 to evacuate or enter from the other end opening of the channel 110. As a result, close adhesion of the belts 56 and 59 and the heat absorbing surfaces 34 can be prevented.

In addition, the channel 110 can include multiple channels unless the belts 56 and 59 and the cooling member 33 closely adheres.

Figure 9:
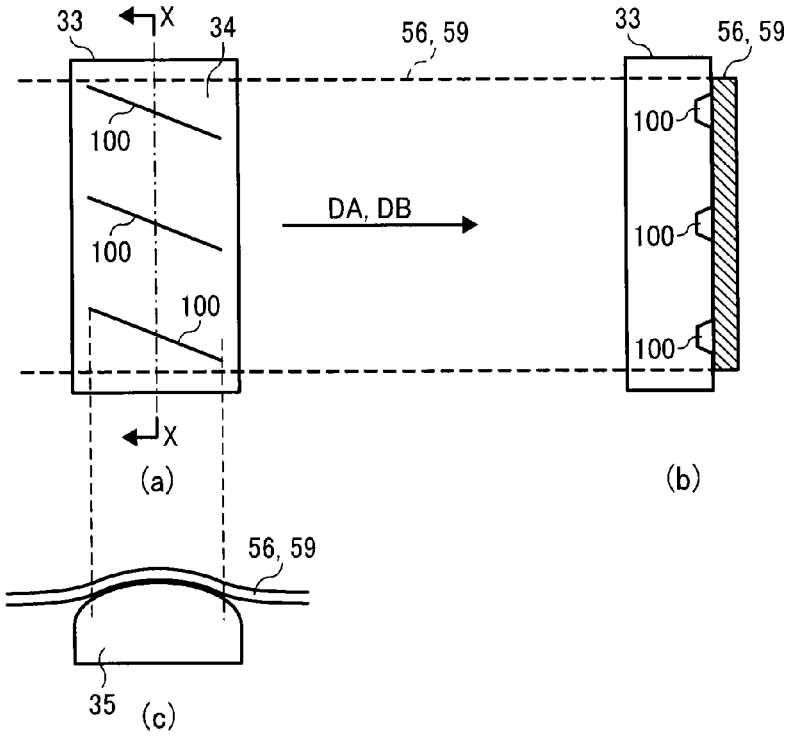
FIG. 9 is a diagram illustrating air flow paths according to yet another example of this disclosure.

FIG. 9 is a diagram illustrating air flow paths according to yet another example of this disclosure.

FIG. 9(*a*) is a plan view illustrating the heat absorbing surface 34. As illustrated in FIG. 9(*a*), the recesses 100 functioning as air flow paths to cause the inner circumferential surfaces of the belts 56 and 59 to expose to outside air are formed on the heat absorbing surface 34 of the cooling member 33. FIG. 9(*b*) is a cross sectional view along a line X-X of FIG. 9(*a*). FIG. 9(*c*) is a side view of FIG. 9(*a*). In this example illustrated in FIGS. 9(*a*) through 9(*c*), the multiple recesses 100 are arranged in the direction intersecting the belt moving direction. Specifically, the multiple recesses 100 are arranged in a direction inclined to the belt moving direction.

Accordingly, the frictional resistance generated when the belts 56 and 59 pressed against the heat absorbing surfaces 34 pass through the recesses 100 is reduced. Further, wear on the inner circumferential surfaces of the belts 56 and 59 caused by contact of the inner circumferential surfaces of the belts 56 and 59 to the recesses 100 can be reduced. It is to be noted that, as illustrated in FIG. 9(*c*), the heat absorbing surface 34 of the cooling member 33 has a projecting, semi-cylindrical shape in the belt moving direction and an upstream end and a downstream end of each recess 100 in the belt moving direction are not blocked by the belts 56 and 59.

Therefore, the recesses 100 communicate with outside air in the belt moving direction, and air flows through the recesses 100 even if the belts 56 and 59 and the heat absorbing surface 34 are in contact with each other.

It is to be noted that a method of forming the recesses 100 is described later in relation to a description of FIG. 15.

Figure 10:
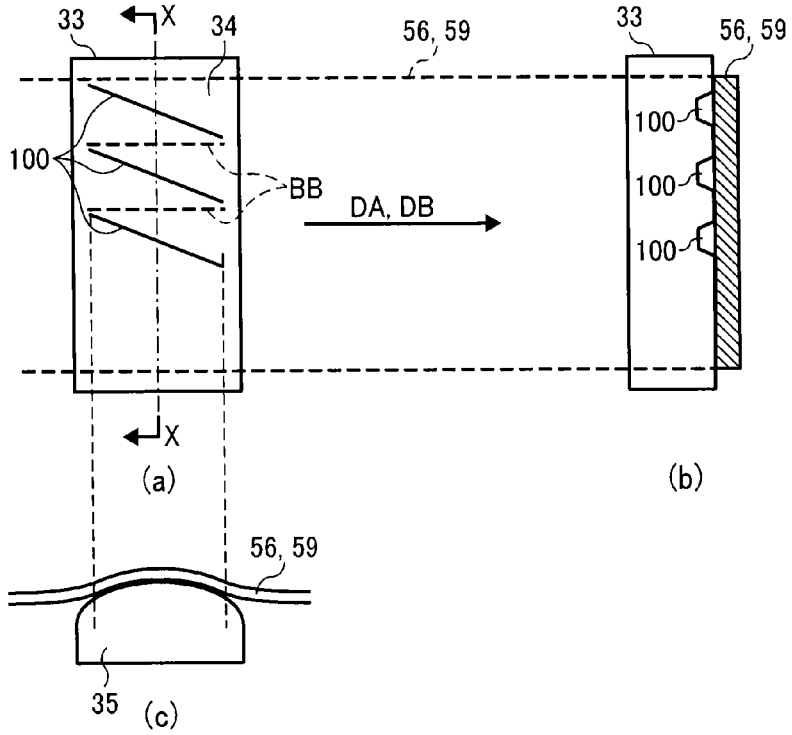
FIG. 10 is a diagram illustrating air flow paths according to yet another example of this disclosure.

FIG. 10 is a diagram illustrating air flow paths according to yet another example of this disclosure.

FIG. 10(*a*) is a plan view illustrating the heat absorbing surface 34. As illustrated in FIG. 10(*a*), the recesses 100 functioning as air flow paths to cause the inner circumferential surfaces of the belts 56 and 59 to expose to outside air are formed on the heat absorbing surface 34 of the cooling member 33. FIG. 10(*b*) is a cross sectional view along a line X-X of FIG. 10(*a*). FIG. 10(*c*) is a side view of FIG. 10(*a*). Similar to FIG. 9(*c*), the upstream end and the downstream end of each recess 100 in the belt moving direction in FIG. 10(*c*) are not blocked by the belts 56 and 59.

In this example illustrated in FIGS. 10(*a*) through 10(*c*), the multiple recesses 100 are arranged in the direction intersecting the belt moving direction. Specifically, the multiple recesses 100 are arranged in a direction inclined to the belt moving direction. Further, the recesses 100 diagonally disposed on the heat absorbing surface 34 are arranged without being overlapped with each other in the belt moving direction.

The recesses 100 are portions where the heat absorbing surface 34 does not contact the belts 56 and 59. If these portions increase, the cooling performance of the recording medium P reduces.

Boundaries BB are indicated by short and dotted lines illustrated in FIG. 10(*a*). As shown using the boundaries BB, by forming the adjacent recesses 100 without being overlapped with each other in the belt moving direction, each recess passing point on the belts 56 and 59 passes the recesses 100 once or one time. Therefore, a reduction in the cooling performance of the recording medium P can be prevented. Further, the recesses 100 are arranged in the direction inclined or obliquely to the belt moving direction. Therefore, this example illustrated in FIG. 10 can reduce the rotational resistances of the belts 56 and 59 when compared to the recesses 100 arranged in the direction perpendicular to the belt moving direction.

Figure 11:
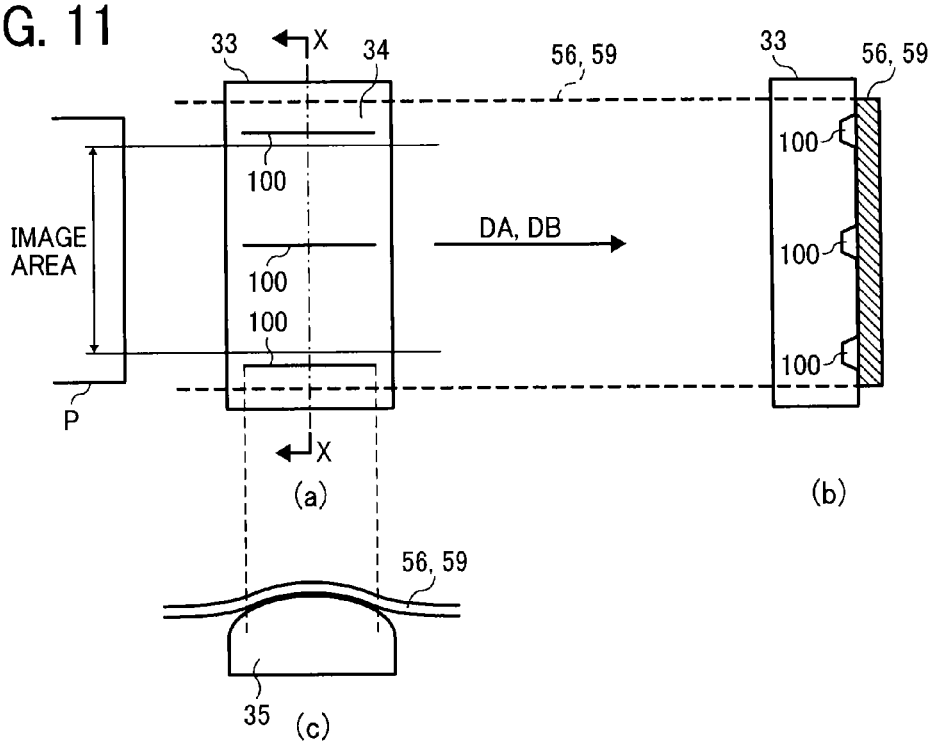
FIG. 11 is a diagram illustrating air flow paths according to yet another example of this disclosure.

FIG. 11 is a diagram illustrating air flow paths according to yet another example of this disclosure.

FIG. 11(*a*) is a plan view illustrating the heat absorbing surface 34. As illustrated in FIG. 11(*a*), the recesses 100 functioning as air flow paths to cause the inner circumferential surfaces of the belts 56 and 59 to expose to outside air are formed on the heat absorbing surface 34 of the cooling member 33. FIG. 11(*b*) is a cross sectional view along a line X-X of FIG. 11(*a*). FIG. 11(*c*) is a side view of FIG. 11(*a*). Similar to FIG. 9(*c*), the upstream end and the downstream end of each recess 100 in the belt moving direction in FIG. 11(*c*) are not blocked by the belts 56 and 59.

In this example illustrated in FIG. 11, the multiple recesses 100 formed on the heat absorbing surface 34 of the cooling member 33 are arranged in the same direction as the belt moving direction. According to this structure, the recesses 100 receive a force to meander the belts 56 and 59, and therefore meandering of the belts 56 and 59 can be prevented.

Further, in order to reduce the number of the recesses 100 formed in an image area, at least one recess 100 is formed on an outside of the image area that corresponds to a margin of the recording medium P. By so doing, close contact or adhesion of the belts 56 and 59 and the heat absorbing surface 34 can be prevented and the image formed within the image area on the recording medium P can be cooled preferably.

Figure 12:
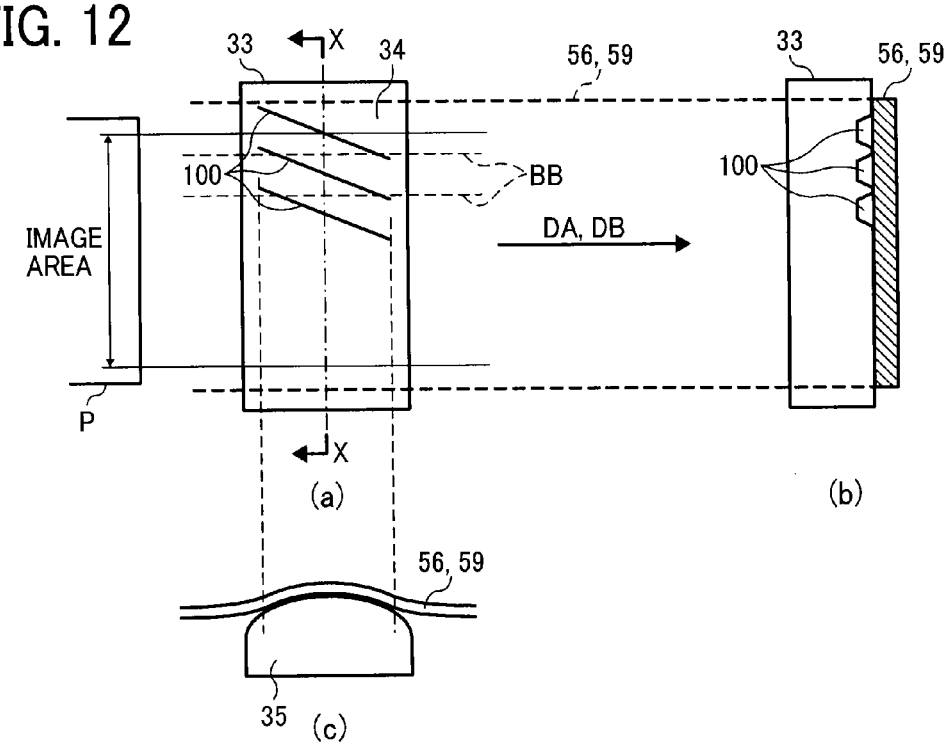
FIG. 12 is a diagram illustrating air flow paths according to yet another example of this disclosure.

FIG. 12 is a diagram illustrating air flow paths according to yet another example of this disclosure.

FIG. 12(*a*) is a plan view illustrating the heat absorbing surface 34. As illustrated in FIG. 12(*a*), the recesses 100 functioning as air flow paths to cause the inner circumferential surfaces of the belts 56 and 59 to expose to outside air are formed on the heat absorbing surface 34 of the cooling member 33. FIG. 12(*b*) is a cross sectional view along a line X-X of FIG. 12(*a*). FIG. 12(*c*) is a side view of FIG. 12(*a*). Similar to FIG. 9(*c*), the upstream end and the downstream end of each recess 100 in the belt moving direction in FIG. 12(*c*) are not blocked by the belts 56 and 59.

In this example illustrated in FIG. 12, the multiple recesses 100 formed on the heat absorbing surface 34 of the cooling member 33 are arranged in the direction intersecting the belt moving direction. Specifically, the multiple recesses 100 are arranged in a direction inclined to the belt moving direction. Further, the recesses 100 diagonally disposed on the heat absorbing surface 34 are arranged to be overlapped with each other in the belt moving direction. Specifically, as indicated by boundaries BB with short and dotted lines within the image area illustrated in FIG. 12(*a*), the recesses 100 are arranged to have the same number of points as the number of recesses 100 in the belt moving direction. In this example, there are two recess passing points on the belts 56 and 59 on each boundary BB indicated by short and dotted lines illustrated in FIG. 12(*a*).

The recesses 100 are portions where the heat absorbing surface 34 does not contact the belts 56 and 59. If these portions increase, the cooling performance of the recording medium P reduces.

For example, when the respective recess passing points on the belts 56 and 59 are different in the number of passage of the recesses 100 in the belt moving direction or in contact lengths with the heat absorbing surface 34, the frequency and area of contact of the belts 56 and 59 and the heat absorbing surface 34 in the belt width direction are also different. Accordingly, it is likely to cause the cooling nonuniformity of the recording medium P.

However, according to this example, the cooling nonuniformity of the belts 56 and 59 and the recording medium P can be prevented. The recesses 100 formed on the heat absorbing surface 34 of the cooling member 33 are arranged to be overlapped with each other in the belt moving direction so that the number of passage of the recesses 100 in the belt moving direction is the same at each recess passing point intersecting the belt moving direction. However, the structure is not limited thereto. For example, the adjacent recesses 100 do not have to overlap in the belt moving direction, as illustrated in FIG. 10(*a*). When the adjacent recesses 100 do not overlap, the number of passage of the recesses 100 in the belt moving direction is once or one time.

Figure 13:
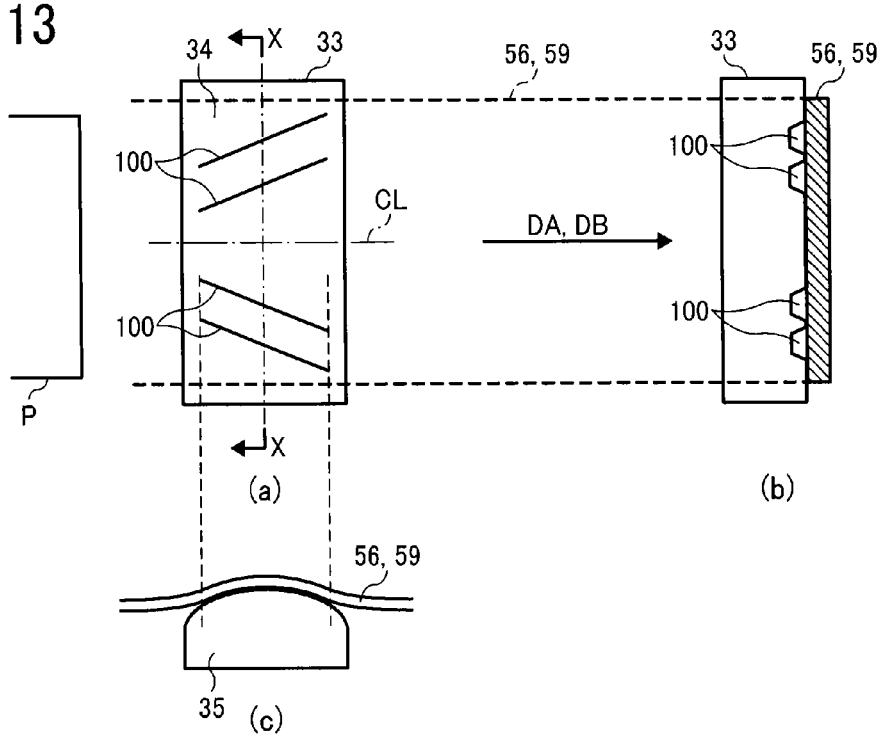
FIG. 13 is a diagram illustrating air flow paths according to yet another example of this disclosure.

FIG. 13 is a diagram illustrating air flow paths according to yet another example of this disclosure. FIG. 13(*a*) is a plan view illustrating the heat absorbing surface 34. As illustrated in FIG. 13(*a*), the recesses 100 functioning as air flow paths to cause the inner circumferential surfaces of the belts 56 and 59 to expose to outside air are formed on the heat absorbing surface 34 of the cooling member 33. FIG. 13(*b*) is a cross sectional view along a line X-X of FIG. 13(*a*). FIG. 13(*c*) is a side view of FIG. 13(*a*). Similar to FIG. 9(*c*), the upstream end and the downstream end of each recess 100 in the belt moving direction in FIG. 13(*c*) are not blocked by the belts 56 and 59.

In this example, the recesses 100 formed on the heat absorbing surface 34 of the cooling member 33 are formed symmetrical to a center line CL of the cooling member 33 in the direction perpendicular to the belt moving direction and tapered from the upstream side to the downstream side in the belt moving direction. According to this structure, resistances of a belt conveyance in the belt width direction are well balanced. Consequently, meandering of the belts 56 and 59 are prevented.

Further, when a center of the recording medium P in the direction perpendicular to the belt moving direction with the center line CL matches the center line CL, the recording medium P is uniformly cooled in a vertical direction sandwiching the center line CL in FIG. 13(*a*).

Figure 14:
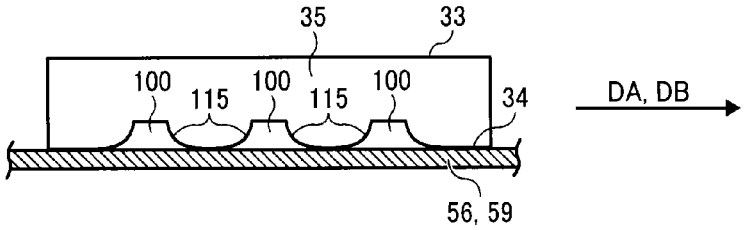
FIG. 14 is a diagram illustrating air flow paths according to yet another example of this disclosure.

FIG. 14 is a diagram illustrating air flow paths according to yet another example of this disclosure.

FIG. 14 is a cross sectional view of the recesses 100 functioning as air flow paths to cause the inner circumferential surfaces of the belts 56 and 59 to expose to outside air are formed on the heat absorbing surface 34 of the cooling member 33. The belts 56 and 59 move while being biased to the heat absorbing surface 34 with a given tension force. Accordingly, corners 115, each defined by the adjacent recesses 100 to which the belts 56 and 59 contact, of the cooling member 33 are curved or have shapes of curve. According to this structure, the belts 56 and 59 are prevented from being cut by the corners 115 and from producing wear particles thereof.

Referring back to FIG. 2, it is preferable to provide the recesses 100 functioning as air flow paths on the heat absorbing surface 34*c* of the cooling member 33*c* that is disposed in the vicinity of or right upstream from the driving roller 57*a* in the belt moving direction DB. Due to the driving roller 57*a*, a given area of the belt 59 between the driving roller 57*a* and the cooling member 33*c* are pulled taut. Since the belt 56 disposed facing the belt 59 also moves while being pressed by the heat absorbing surface 34*c* via the belt 59, the frictional resistance between the belts 56 and 59 and the heat absorbing surface 34*c* increases. By forming the recesses 100 on the heat absorbing surface 34*c*, an increase in the frictional resistance between the belts 56 and 59 and the heat absorbing surface 34*c* can be prevented.

Figure 15A:
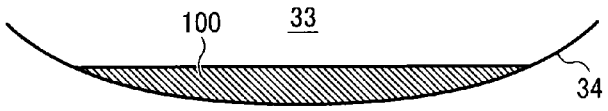
FIGS. 15A and 15B are a schematic cross sectional views illustrating the recording medium cooling device and the air flow path.
Figure 15B:
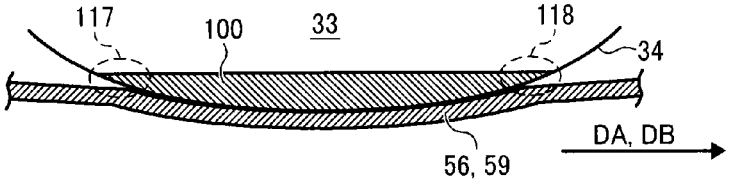

FIGS. 15A and 15B are a schematic cross sectional views illustrating the recording medium cooling device 9 and the air flow path.

The recesses 100 functioning as the air flow paths can be formed by cutting in the same depth along an arc of the protruding top face of the heat absorbing surface 34 using a cutting member such as a cutter or by rotating using another cutting member such as a circular saw. As can be seen from FIG. 15A, when a circular saw is used, a user can easily cut the heat absorbing surface 34 by moving the circular saw or the cooling member 33 in a horizontal direction or in the left-to-right direction, so that a good operability can be achieved. In this case, if the recesses 100 are formed throughout the heat absorbing surface 34 of the cooling member 33, the gutter becomes too deep. Therefore, cutting the heat absorbing surface 34 is preferably made to a given depth.

Further, as shown with gaps 117 and 118 illustrated in FIG. 15B, the belts 56 and 59 are attached to the cooling member 33 with the gaps 117 and 118 therebetween so as to cause the recesses 100 to communicate with the outside of the recording medium cooling device 9. By so doing, air flows through the recesses 100 via the gaps 117 and 118.

Figure 16:
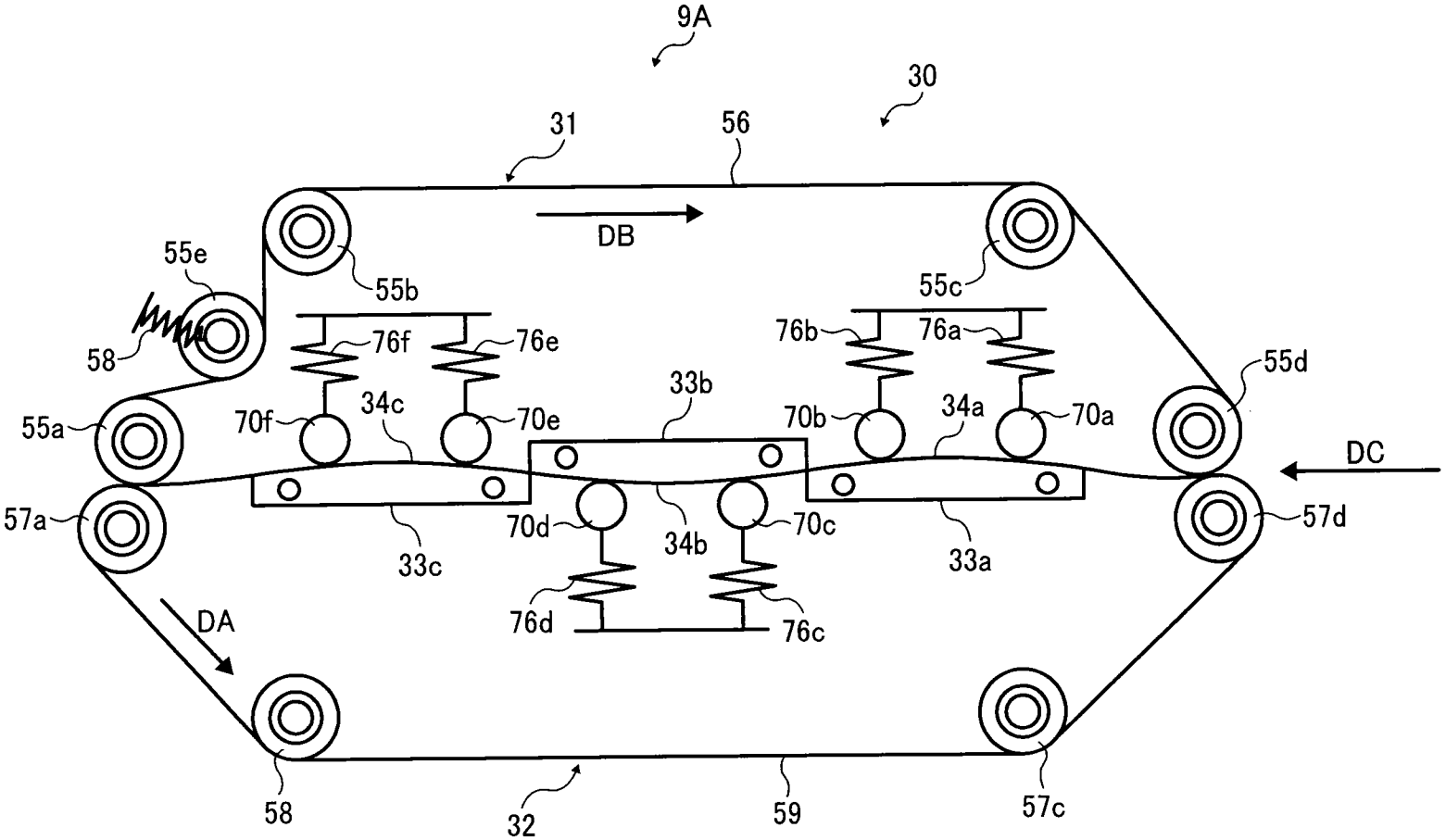
FIG. 16 is a schematic diagram illustrating a recording medium cooling device according to another example of this disclosure.

FIG. 16 is a schematic diagram illustrating a recording medium cooling device 9A according to another example of this disclosure.

Units and components in a configuration of the recording medium cooling device 9A illustrated in FIG. 16 are basically identical to those in the configuration of the recording medium cooling device 9 illustrated in FIG. 2, except that the recording medium cooling device 9A further includes pressure rollers 70*a*, 70*b*, 70*c*, 70*d*, 70*e*, and 70*f*.

As illustrated in FIG. 16, the pressure rollers 70*a*, 70*b*, 70*c*, 70*d*, 70*e*, and 70*f* are biased by springs 76*a*, 76*b*, 76*c*, 76*d*, 76*e*, and 76*f*, respectively, and press the belts 56 and 59 against the heat absorbing surfaces 34*a*, 34*b*, and 34*c*. Each of the springs 76*a*, 76*b*, 76*c*, 76*d*, 76*e*, and 76*f* functions as a biasing member.

According to this configuration, a good heat conductivity is maintained between the belts 56 and 59 and the heat absorbing surface 34, and therefore, when the recording medium P passes between the belts 56 and 59, cooling of the recording medium is facilitated.

Figure 17:
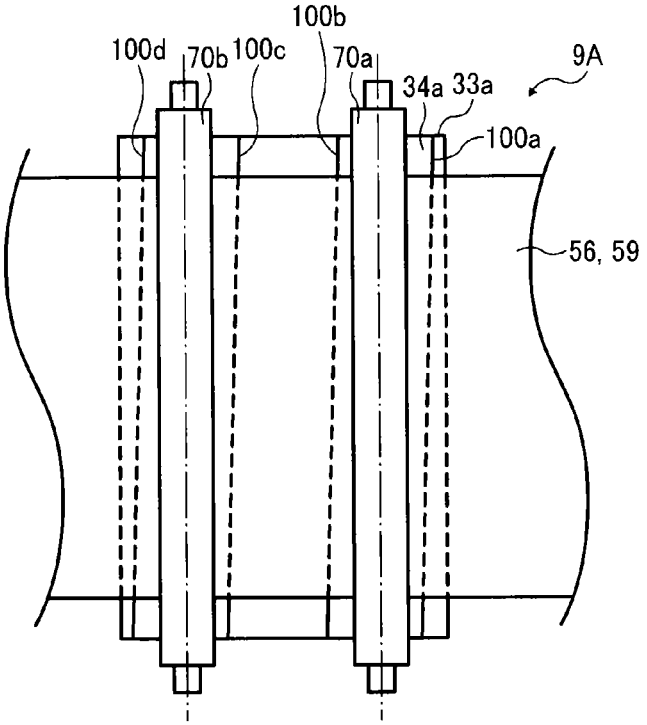
FIG. 17 is a diagram illustrating a configuration of pressure rollers and respective recesses formed on a heat absorbing surface with the belts interposed therebetween in the recording medium cooling device of FIG. 16.

FIG. 17 is a diagram illustrating a configuration of the pressure rollers 70*a* and 70*b* and respective recesses 100*a*, 100*b*, 100*c*, and 100*d* formed on the heat absorbing surface 34 of the cooling member 33 with the belts 56 and 59 interposed therebetween in the recording medium cooling device 9A of FIG. 16. FIG. 17 is a schematic plan view illustrating the heat absorbing surface 34 of the cooling member 33, viewed from the pressure rollers 70*a* and 70*b*.

As illustrated in FIG. 17, the pressure rollers 70*a* and 70*b* and the recesses 100*a*, 100*b*, 100*c*, and 100*d* are disposed not to directly contact with each other due to the belts 56 and 59 sandwiched therebetween.

In this example, the recess 100*a* is disposed on the heat absorbing surface 34*a* at an upstream position from the pressure roller 70*a* in the belt moving direction, the recesses 100*b* and 100*c* are disposed on the heat absorbing surface 34*a* between the pressure rollers 70*a* and 70*b*, and the recess 100*d* is disposed on the heat absorbing surface 34*a* at a downstream position from the pressure roller 70*b* in the belt moving direction. The recesses 100*a*, 100*b*, 100*c*, and 100*d* are not parallel to respective shafts of the pressure rollers 70*a* and 70*b* but are slightly inclined or slanted to the belt moving direction. As illustrated in FIG. 17, the pressure rollers 70*a* and 70*b* and the recesses 100*a*, 100*b*, 100*c*, and 100*d* have the belts 56 and 59 interposed therebetween, and therefore do not intersect to each other.

Accordingly, when the inner circumferential surfaces of the belts 56 and 59 slide on the heat absorbing surface 34 of the cooling member 33, an increase in contact pressure of the belts 56 and 59 and the recesses 100*a*, 100*b*, 100*c*, and 100*d* is prevented, and therefore production of wear and wear particles of the belts 56 and 59 due to friction of the belts 56 and 59 and the recesses 100*a*, 100*b*, 100*c*, and 100*d* is not facilitated. In other words, occurrence of wear and wear particles of the belts 56 and 59 is restricted.

Consequently, accumulation of wear particles between the heat absorbing surface 34 of the cooling member 33 and the belts 56 and 59 is prevented, and therefore a reduction in heat exchange efficiency between the belts 56 and 59 and the cooling member 33 and a reduction in cooling efficiency of the recording medium cooling device 9A can be prevented.

Further, the recording medium P after a fixing operation by application of heat and pressure is sufficiently cooled. Therefore, blocking can be prevented. "Blocking" is caused as follows. When the recording medium P is stacked in the output tray 20 while heated, toner on the recording medium P is softened by the heat. The softened toner causes the adjacent recording media P in the sheet stack on the output tray 20 to be bonded due to pressure by the weight of the recording media P.

Further, the pressure rollers 70*a*, 70*b*, 70*c*, 70*d*, 70*e*, and 70*f* can prevent occurrence of wear particles while maintaining preferable heat conductivities of the recording medium P, the belts 56 and 59, and the heat absorbing surface 34. The recesses 100*a*, 100*b*, 100*c*, and 100*d* are disposed from the upstream side to the downstream side (from the right side to the left side in FIG. 17) of the heat absorbing surface 34, and therefore the belts 56 and 59 and the heat absorbing surface 34 uniformly contact over the entire heat absorbing surface 34, and therefore the belts 56 and 59 can move stably.

As described above, in the example illustrated in FIG. 17, the recess 100*a* is disposed on the heat absorbing surface 34*a* at an upstream position from the pressure roller 70*a* in the belt moving direction, the recesses 100*b* and 100*c* are disposed on the heat absorbing surface 34*a* between the pressure rollers 70*a* and 70*b*, and the recess 100*d* is disposed on the heat absorbing surface 34*a* at a downstream position from the pressure roller 70*b* in the belt moving direction. However, the configuration of this disclosure is not limited thereto. For example, one or two of the recesses 100*a*, 100*b*, 100*c*, and 100*d* can be disposed at any of the upstream side from the pressure roller 70*a* in the belt moving direction, in between the pressure rollers 70*a* and 70*b*, and the downstream side from the pressure roller 70*b* in the belt moving direction.

It is to be noted that the same effect can be achieved with the heat absorbing surface 34*b* pressed by the pressure rollers 70*c* and 70*d* and the heat absorbing surface 34*c* pressed by the pressure rollers 70*e* and 70*f*.

Figure 18:
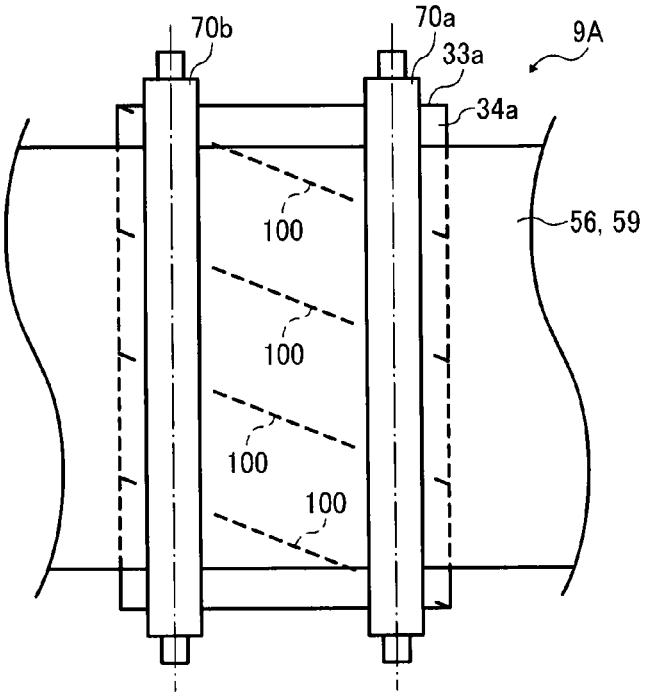
FIG. 18 is a diagram illustrating another configuration of the pressure rollers and the respective recesses formed on the heat absorbing surface with the belts interposed therebetween in the recording medium cooling device of FIG. 16.

FIG. 18 is a diagram illustrating another configuration of the pressure rollers 70*a* and 70*b* and the recesses 100 formed on the heat absorbing surface 34 of the cooling member 33 with the belts 56 and 59 interposed therebetween in the recording medium cooling device 9A of FIG. 16. FIG. 18 is a schematic plan view illustrating the heat absorbing surface 34 of the cooling member 33 (i.e., the heat absorbing surface 34*a* of the cooling member 33*a*), viewed from the pressure rollers 70*a* and 70*b*.

As illustrated in FIG. 18, the pressure rollers 70*a* and 70*b* and the multiple recesses 100 are disposed not to directly contact with each other due to the belts 56 and 59 sandwiched therebetween.

In this example, the multiple recesses 100, each having a gutter shape, extend in the direction inclined or slanted to the belt moving direction from the upstream side to the downstream side of the heat absorbing surface 34. However, it is to be noted that the gutters of the recesses 100 are cut off at areas where the recesses 100 intersect with the pressure rollers 70*a* and 70*b* via the belts 56 and 59. Therefore, the belts 56 and 59 contact the heat absorbing surface 34 having no recesses 100 formed thereon in areas in which the pressure rollers 70*a* and 70*b* press the belts 56 and 59. Accordingly, the pressure rollers 70*a* and 70*b* can prevent occurrence of wear particles while maintaining preferable heat conductivities of the recording medium P, the belts 56 and 59, and the heat absorbing surface 34.

In this example illustrated in FIG. 18, a direction in which the recesses 100 extend is closer to the belt moving direction than that the direction in which the recesses 100 extend in the example illustrated in FIG. 17. Therefore, the frictional resistance generated when the belts 56 and 59 pressed against the heat absorbing surface 34 pass the recesses 100 is reduced, and therefore wear on the inner circumferential surfaces of the belts 56 and 59 caused by abutment of the inner circumferential surfaces thereof against the recesses 100 can be prevented.

It is to be noted that the same effect can be achieved with the heat absorbing surface 34*b* pressed by the pressure rollers 70*c* and 70*d* and the heat absorbing surface 34*c* pressed by the pressure rollers 70*e* and 70*f*.

Figure 19A:
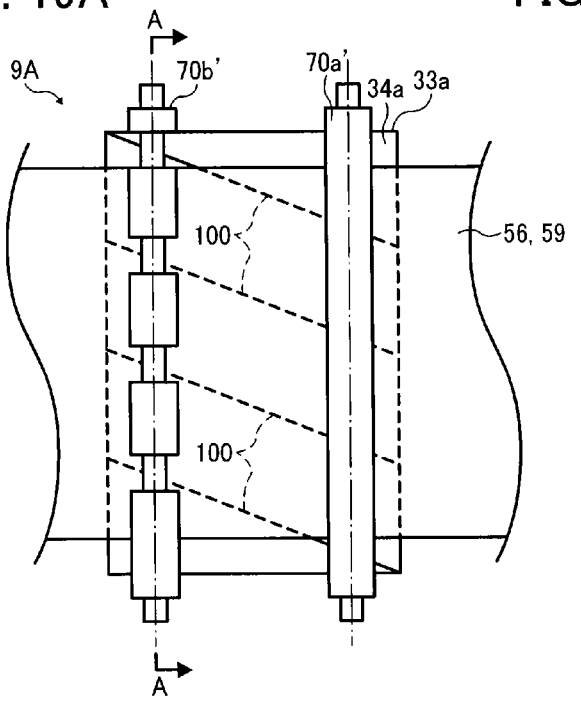
FIGS. 19A and 19B are diagrams illustrating yet another configuration of the pressure rollers and the respective recesses formed on the heat absorbing surface with the belts interposed therebetween in the recording medium cooling device of FIG. 16.
Figure 19B:
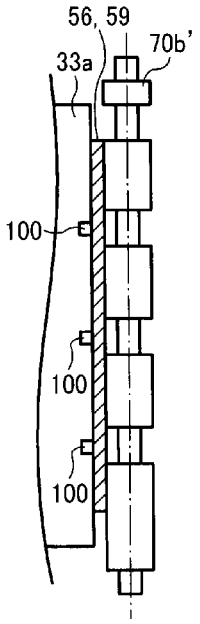

FIGS. 19A and 19B are diagrams illustrating yet another configuration of pressure rollers 70*a*' and 70*b*' and the respective recesses 100 formed on the heat absorbing surface 34 with the belts 56 and 59 interposed therebetween in the recording medium cooling device 9A of FIG. 16. FIG. 19A is a schematic plan view of the heat absorbing surface 34 of the cooling member 33 (i.e., the heat absorbing surface 34*a* of the cooling member 33*a*), viewed from the pressure rollers 70*a*' and 70*b*'. FIG. 19B is a schematic cross sectional view along a line A-A of FIG. 19A.

As illustrated in FIGS. 19A and 19B, the pressure rollers 70*a*' and 70*b*' and the multiple recesses 100 are disposed not to directly contact with each other due to the belts 56 and 59 sandwiched therebetween.

In this example, the multiple recesses 100, each having a gutter shape, extend in the direction inclined or slanted to the belt moving direction from the upstream side to the downstream side of the heat absorbing surface 34. Further, a diameter of the pressure roller 70*b*' in areas in which the pressure roller 70*b*' intersects with the recesses 100 via the belts 56 and 59 is smaller than a diameter of the pressure roller 70*b*' in areas in which the pressure roller 70*b*' does not intersect with the recesses 100 via the belts 56 and 59. Therefore, as illustrated in FIGS. 19A and 19B, the belts 56 and 59 contact the heat absorbing surface 34 having no recesses 100 formed thereon in areas in which the pressure roller 70*b*' presses the belts 56 and 59. Accordingly, the pressure rollers 70*a* and 70*b* can prevent occurrence of wear particles while maintaining preferable contactness and heat conductivities of the recording medium P, the belts 56 and 59, and the heat absorbing surface 34.

In this example illustrated in FIGS. 19A and 19B, the direction in which the recesses 100 extend is closer to the belt moving direction than that the direction in which the recesses 100 extend in the example illustrated in FIG. 17. Therefore, the frictional resistance generated when the belts 56 and 59 pressed against the heat absorbing surface 34 pass the recesses 100 is reduced, and therefore wear on the inner circumferential surfaces of the belts 56 and 59 caused by abutment of the inner circumferential surfaces thereof against the recesses 100 can be prevented.

It is to be noted that the same effect can be achieved with the heat absorbing surface 34*b* pressed by the pressure rollers 70*c* and 70*d* and the heat absorbing surface 34*c* pressed by the pressure rollers 70*e* and 70*f*.

Figure 20A:
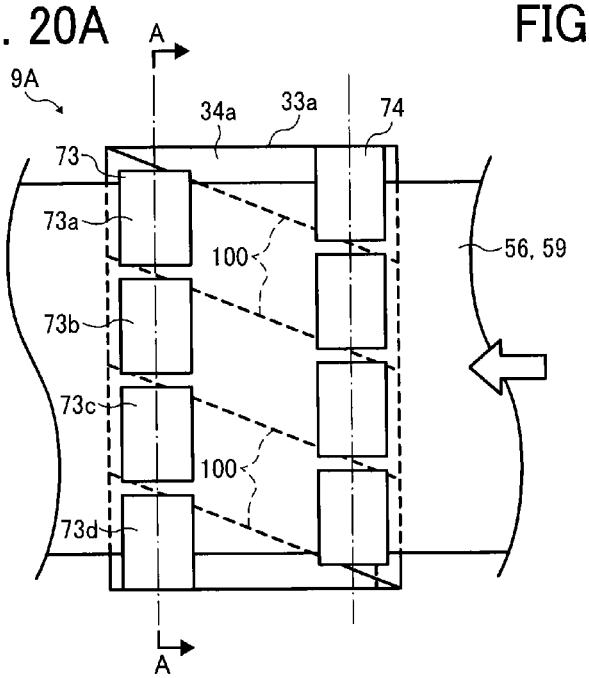
FIGS. 20A and 20B are diagrams illustrating yet another configuration of the pressure rollers and the respective recesses formed on the heat absorbing surface with the belts interposed therebetween in the recording medium cooling device of FIG. 16.
Figure 20B:
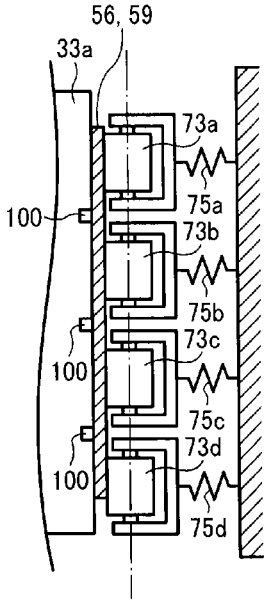

FIGS. 20A and 20B are diagrams illustrating yet another configuration of pressure rollers 73 and 74 and the respective recesses 100 formed on the heat absorbing surface 34 with the belts 56 and 59 interposed therebetween in the recording medium cooling device 9A of FIG. 16. FIG. 20A is a schematic plan view of the heat absorbing surface 34 of the cooling member 33 (i.e., the heat absorbing surface 34*a* of the cooling member 33*a*), viewed from the pressure rollers 73 and 74. FIG. 20B is a schematic cross sectional view along a line A-A of FIG. 20A.

As illustrated in FIGS. 20A and 20B, the pressure rollers 73 and 74 and the multiple recesses 100 are disposed not to directly contact with each other due to the belts 56 and 59 sandwiched therebetween.

In this example, the pressure rollers 73 and 74 are divided pressure roller sets, each having multiple rollers divided at points where the pressure roller (i.e., the pressure rollers 73 and 74) intersects with the recesses 100 via the belts 56 and 59. The divided multiple rollers of the pressure rollers 73 and 74 are biased by biasing members 75 (e.g., biasing members 75*a*, 75*b*, 75*c*, and 75*d* illustrated in FIG. 20B) fixed to the apparatus body 85 of the image forming apparatus 200.

As illustrated in FIG. 20A, the pressure rollers 73 and 74 including respective multiple divided rollers are disposed facing the heat absorbing surface 34 of the cooling member 33. Further, as illustrated in FIG. 20B, the pressure roller 73 has multiple divided rollers 73*a*, 73*b*, 73*c*, and 73*d* disposed at respective points where the pressure roller 73 intersects the recesses 100 via the belts 56 and 59. Further, the multiple divided rollers 73*a*, 73*b*, 73*c*, and 73*d* of the pressure roller 73 are individually biased by the biasing members 75*a*, 75*b*, 75*c*, and 75*d*, respectively. In this example, the biasing members 75*a*, 75*b*, 75*c*, and 75*d* are springs.

When the belts 56 and 59 move in the sheet conveying direction DC as indicated by arrow illustrated in FIG. 20A, the belts 56 and 59 are likely to approach or meander upwardly in FIG. 20A along the recesses 100 formed on the heat absorbing surface 34.

In order to address the inconvenience, respective spring pressures of the biasing members 75*a*, 75*b*, 75*c*, and 75*d* are adjusted so that respective biasing forces on a side on which the recesses 100 incline to the sheet conveying direction DC become greater. In this example, the respective spring pressures Pa, Pb, Pc, and Pd of the biasing members 75*a*, 75*b*, 75*c*, and 75*d*, respectively, are represented as "Pa>Pb>Pc>Pd". The belts 56 and 59 generally move from a side applied with a greater biasing force of a biasing member to another side applied with a smaller biasing force of the biasing member. Therefore, adjustment of a spring pressure can prevent the belts 56 and 59 from approaching or meandering upwardly in the FIG. 20A along the recesses 100. Similarly, meandering of the pressure roller 73 having the multiple divided rollers 73*a*, 73*b*, 73*c*, and 73*d* can be prevented.

Further, the biasing forces of the biasing members 75*a*, 75*b*, 75*c*, and 75*d* are not limited to the above-described example. For example, the respective spring pressures Pa, Pb, Pc, and Pd of the biasing members 75*a*, 75*b*, 75*c*, and 75*d*, respectively, may be represented as "Pa>Pb=Pc>Pd". Any relation of the spring pressures is acceptable as long as the spring pressure becomes greater on the side where the recesses 100 incline to the sheet conveying direction DC.

It is to be noted that the same effect can be achieved with the heat absorbing surfaces 34*b* and 34*c*.

As described above, the examples of the configurations and functions of the recording medium cooling devices 9 and 9A incorporatable in the image forming apparatus 200 are described with reference to the corresponding drawings. However, this disclosure is not limited to the above-described examples. For example, the number and positions of the recesses 100 can be changed in the recording medium conveyor, e.g., the recording medium cooling device 9. Further, the recording medium conveyor is not limited to the configuration in which the belt (i.e., the belts 56 and 59) and the cooling member (i.e., the cooling member 33) are disposed in both of the first conveyance assembly 31 and the second conveyance assembly 32.

For example, the cooling member 33 may be provided to one of the first conveyance assembly 31 and the second conveyance assembly 32.

Figure 21:
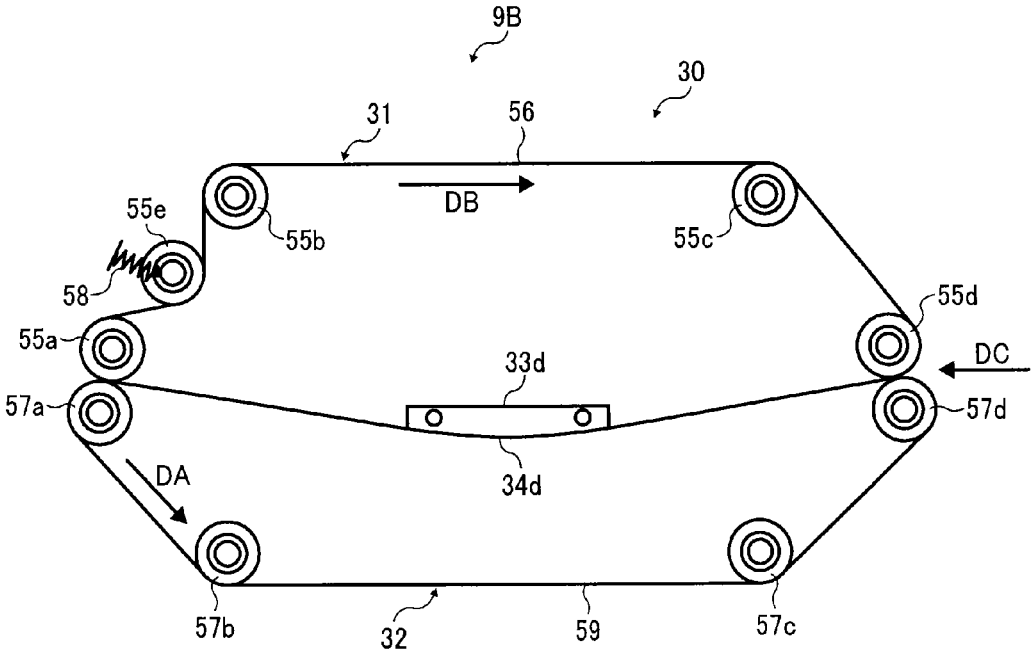
FIG. 21 is a schematic diagram illustrating a recording medium cooling device according to yet another example of this disclosure.

FIG. 21 is a schematic diagram illustrating a recording medium cooling device 9B according to yet another example of this disclosure.

As illustrated in FIG. 21, the recording medium cooling device 9B that functions as a recording medium conveyor includes a cooling member 33*d* having a heat absorbing surface 34*d*. Units and components used in the recording medium cooling device 9B illustrated in FIG. 21 are identical to those used in the recording medium cooling device 9 illustrated in FIG. 2, except that the recording medium cooling device 9B has one cooling member, which is the cooling member 33*d*. Therefore, detailed description of the configuration and functions of the recording medium cooling device 9B is omitted here.

The heat absorbing surface 34*d* of the cooling member 33*d* is disposed in contact with the inner circumferential surface of the belt 56 of the first conveyance assembly 31. As illustrated in FIG. 21, no cooling member is provided to the second conveyance assembly 32. However, it is to be noted that the recording medium cooling device 9B of this example illustrated in FIG. 21 can achieve the same effect as the recording medium cooling device 9 illustrated in FIG. 2.

Further, a roller may be provided to the recording medium cooling device to function as one of the first conveyance assembly 31 and the second conveyance assembly 32 instead of providing the belt and the cooling member of the corresponding conveyance assembly.

Figure 22:
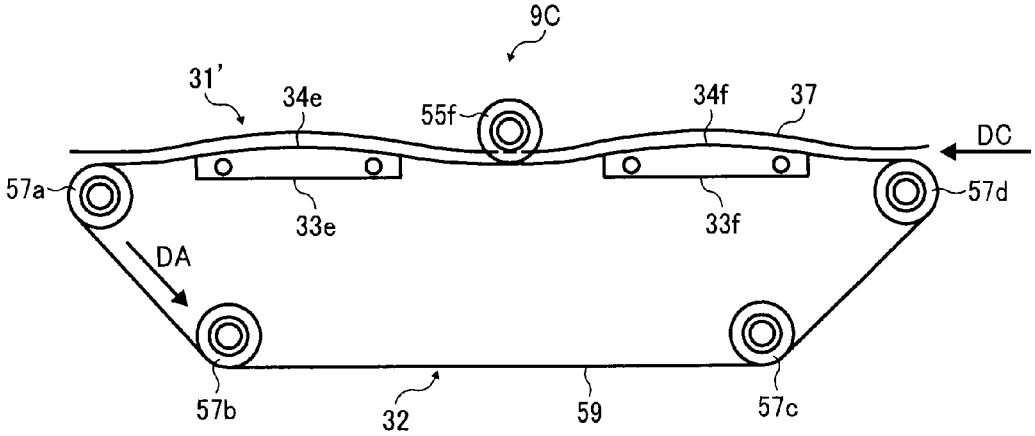
FIG. 22 is a schematic diagram illustrating a recording medium cooling device according to yet another example of this disclosure.

For example, FIG. 22 is a schematic diagram illustrating a recording medium cooling device 9C according to yet another example of this disclosure.

As illustrated in FIG. 22, the recording medium cooling device 9C that functions as a recording medium conveyor includes a roller 55*f* as an alternative first conveyance assembly 31'. Units and components used in the recording medium cooling device 9C illustrated in FIG. 22 are identical to those used in the recording medium cooling device 9 illustrated in FIG. 2, except that the recording medium cooling device 9C does not have the first conveyance assembly 31 including the cooling member 33*b* but has the roller 55*f* and two cooling members, which are cooling members 33*e* and 33*f* having heat absorbing surfaces 34*e* and 34*f*, respectively. Therefore, detailed description of the configuration and functions of the recording medium cooling device 9C is omitted here. The recording medium cooling device 9C further includes a guide 37 to guide a recording medium. The roller 55*f* and the belt 59 convey the recording medium.

The heat absorbing surfaces 34*e* and 34*f* of the cooling members 33*e* and 33*f* are disposed in contact with the inner circumferential surface of the belt 59 of the second conveyance assembly 32. As illustrated in FIG. 22, the roller 55*f* functions as the alternative first conveyance assembly 31'. However, it is to be noted that the recording medium cooling device 9C of this example illustrated in FIG. 22 can achieve the same effect as the recording medium cooling device 9 illustrated in FIG. 2.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A recording medium conveyor comprising:

a first conveyor; and a second conveyor disposed facing the first conveyor, and the first conveyor and the second conveyor to sandwich a recording medium therebetween and convey the recording medium to a downstream side of an image forming apparatus in a recording medium conveying direction, at least one of the first conveyor and the second conveyor including:

a belt including an inner circumferential face; and a cooler to cool the recording medium, the cooler including a contact face that contacts the inner circumferential face of the belt, the contact face includes at least one recess that forms an air flow path to expose the inner circumferential face of the belt to open air, and the at least one recess extends in a belt moving direction from a most upstream portion of the contact face to a most downstream portion of the contact face.

2. The recording medium conveyor according to claim 1, wherein the at least one of the first conveyor and the second conveyor includes a tensioner to stretch the belt with tension.

3. The recording medium conveyor according to claim 1, wherein the at least one recess is arranged in a direction intersecting a belt moving direction.

4. The recording medium conveyor according to claim 3, wherein the at least one recess is arranged in a direction inclined to the belt moving direction.

5. The recording medium conveyor according to claim 4, wherein the at least one recess includes multiple recesses provided on the contact face of the cooler, wherein adjacent recesses of the multiple recesses are arranged without being overlapped with each other in the belt moving direction, wherein recess passing points on the belt pass respective recesses one time.

6. The recording medium conveyor according to claim 4, wherein the at least one recess includes multiple recesses provided on the contact face of the cooler, wherein adjacent recesses of the multiple recesses are arranged to overlap with each other in the belt moving direction, wherein recess passing points on the belt pass respective recesses in the belt moving direction for a same number of times as each other.

7. The recording medium conveyor according to claim 4, wherein the at least one recess includes multiple recesses provided on the contact face of the cooler, wherein adjacent recesses of the multiple recesses are arranged to overlap with each other in the belt moving direction, wherein recess passing points on the belt include a same contact length as each other in the belt moving direction.

8. The recording medium conveyor according to claim 4, wherein the at least one recess is formed symmetrical to a center line of the cooler in a direction perpendicular to the belt moving direction.

9. The recording medium conveyor according to claim 3, wherein the at least one recess is arranged in a direction perpendicular to the belt moving direction.

10. The recording medium conveyor according to claim 1, wherein the at least one recess is arranged in a same direction as a belt moving direction.

11. An image forming apparatus comprising:

an image forming part to form an image on a recording medium; and the recording medium conveyor according to claim 1 to convey the recording medium.

12. The recording medium conveyor according to claim 1, wherein the cooler includes an inlet and an outlet, and wherein a liquid coolant enters the cooler through the inlet and is discharged from the cooler through the outlet.

13. A recording medium conveyor comprising:

a first conveyor; and a second conveyor disposed facing the first conveyor, and the first conveyor and the second conveyor to sandwich a recording medium therebetween and convey the recording medium to a downstream side of an image forming apparatus in a recording medium conveying direction, at least one of the first conveyor and the second conveyor including:

a belt including an inner circumferential face; and a cooler to cool the recording medium, the cooler including a contact face that contacts the inner circumferential face of the belt, the contact face includes at least one recess that forms an air flow path to expose the inner circumferential face of the belt to open air, and the air flow path is a channel including one end on the contact face and the other end on a side face of the cooler that is different from the contact face.

14. The recording medium conveyor according to claim 13, wherein the cooler includes a corner defined by the air flow path, wherein the corner is curved.

15. The recording medium conveyor according to claim 13, wherein the cooler includes an inlet and an outlet, and wherein a liquid coolant enters the cooler through the inlet and is discharged from the cooler through the outlet.

16. An image forming apparatus comprising:

an image forming part to form an image on a recording medium; and the recording medium conveyor according to claim 13 to convey the recording medium.

17. A recording medium conveyor comprising:

a first conveyor; and a second conveyor disposed facing the first conveyor, and the first conveyor and the second conveyor to sandwich a recording medium therebetween and convey the recording medium to a downstream side of an image forming apparatus in a recording medium conveying direction, the first conveyor including:

a belt including an inner circumferential face; and a cooler to cool the recording medium, the cooler including a contact face that contacts the inner circumferential face of the belt, and the cooler including at least one air flow path to expose the inner circumferential face of the belt to open air, the at least one air flow path including:

a first opening at the contact face, a second opening at a side face of the cooler that is different from the contact face, and the second opening is independent from the first opening, and a channel that is formed inside the cooler and is to flow open air between the first opening and the second opening.

18. The recording medium conveyor according to claim 17, wherein the cooler includes an inlet and an outlet, and wherein a liquid coolant enters the cooler through the inlet and is discharged from the cooler through the outlet.

19. An image forming apparatus comprising:

an image forming part to form an image on a recording medium; and the recording medium conveyor according to claim 17 to convey the recording medium.

* * * * *